US010753169B2

(12) United States Patent
Arefi et al.

(10) Patent No.: US 10,753,169 B2
(45) Date of Patent: Aug. 25, 2020

(54) INTELLIGENT PRESSURE CONTROL DEVICES AND METHODS OF USE THEREOF

(71) Applicant: Schlumberger Technology Corporation, Sugar Land, TX (US)

(72) Inventors: Babak Bob Arefi, Spring, TX (US); Shunfeng Zheng, Katy, TX (US); Jacques Orban, Katy, TX (US); Vishwanathan Parmeshwar, Houston, TX (US); Dursun Sedat Kilic, Katy, TX (US); Ray Cummins, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 264 days.

(21) Appl. No.: 15/465,184

(22) Filed: Mar. 21, 2017

(65) Prior Publication Data

US 2018/0274323 A1 Sep. 27, 2018

(51) Int. Cl.
*E21B 33/00* (2006.01)
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS 5,588,491 A * 12/1996 Brugman ..... E21B 33/085 166/383
7,921,937 B2 4/2011 Brackin et al.
7,980,326 B2 7/2011 Tibbitts et al.
8,201,628 B2 6/2012 Lovorn et al.
8,261,826 B2 9/2012 Lovorn et al.
8,281,875 B2 10/2012 Lovorn et al.
8,347,957 B2 1/2013 Stephenson et al.
8,397,836 B2 3/2013 Pool et al.
8,833,488 B2 9/2014 Knudsen et al.
8,899,348 B2 12/2014 Henderson et al.
8,905,157 B2 12/2014 Jiao et al.
(Continued)

FOREIGN PATENT DOCUMENTS

CN 104594818 A 5/2015
WO 2016167747 A1 10/2016
WO 2017035041 A1 3/2017

*Primary Examiner* — Shane Bomar
*Assistant Examiner* — Steven A MacDonald
(74) *Attorney, Agent, or Firm* — Rachel E. Greene

(57) ABSTRACT

A pressure control device may include a body having a central axis extending therefrom; at least one rotatable seal within the body, the rotatable seal configured to seal against a tubular extending through the pressure control device along the central axis and rotate within the body with the tubular; at least one coil within the body wrapped at least once around the central axis, wherein the at least one coil is configured to send characteristics of the tubular to a controller; an outlet to divert fluid from an annulus, wherein the outlet being located axially below the at least one rotatable seal, wherein the controller is configured to control the at least one rotatable seal and its engagement against the tubular based on the characteristics of the tubular received by the controller.

14 Claims, 18 Drawing Sheets

(56) References Cited

U.S. PATENT DOCUMENTS

| | | | | |
|---|---|---|---|---|
| 9,080,407 | B2 | 7/2015 | Bernard | |
| 9,169,700 | B2 | 10/2015 | Curtis et al. | |
| 9,249,638 | B2 | 2/2016 | Bernard | |
| 2008/0105462 | A1* | 5/2008 | May | E21B 33/085 175/7 |
| 2008/0296016 | A1 | 12/2008 | Hughes et al. | |
| 2010/0012317 | A1* | 1/2010 | Shelton | E21B 33/085 166/250.01 |
| 2012/0067594 | A1* | 3/2012 | Noske | E21B 34/08 166/373 |
| 2014/0299377 | A1 | 10/2014 | Abbassian et al. | |
| 2014/0311738 | A1* | 10/2014 | Hay | E21B 49/083 166/264 |
| 2014/0311806 | A1* | 10/2014 | Bruder | H02K 7/1869 175/104 |
| 2015/0167415 | A1* | 6/2015 | Leuchtenberg | E21B 33/038 137/14 |
| 2015/0308253 | A1* | 10/2015 | Clark | E21B 33/085 175/24 |
| 2016/0061776 | A1* | 3/2016 | Aslanyan | E21B 47/01 324/339 |
| 2016/0186522 | A1* | 6/2016 | Peer | E21B 33/04 166/65.1 |
| 2016/0334018 | A1* | 11/2016 | Travis | E21B 33/085 |
| 2017/0009550 | A1* | 1/2017 | Leuchtenberg | E21B 33/085 |
| 2017/0096858 | A1* | 4/2017 | Watters | E21B 33/085 |
| 2017/0226813 | A1 | 8/2017 | Northam et al. | |
| 2017/0226846 | A1* | 8/2017 | Gray | E21B 47/09 |
| 2018/0245444 | A1* | 8/2018 | Hardt | E21B 33/085 |
| 2018/0252092 | A1* | 9/2018 | Plotnikov | E21B 47/082 |
| 2018/0340383 | A1* | 11/2018 | Bakker | E21B 33/085 |

* cited by examiner

INTELLIGENT PRESSURE CONTROL DEVICES AND METHODS OF USE THEREOF

BACKGROUND

Exploration for, location of, and extraction of subterranean fluids, including hydrocarbon fluids, typically involves drilling operations to create a well. Drilling operations, particularly drilling operations involving rotary drilling, often utilize drilling fluids, also called muds, for a variety of reasons including lubrication, removal of cuttings and other matter created during the drilling process, and to provide sufficient pressure to ensure that fluids located in subterranean reservoirs do not enter the borehole, or wellbore, and travel to the surface of the earth. Fluids located in subterranean reservoirs are under pressure from the overburden of the earth formation above them. Specialized equipment is used to provide control of all fluids used or encountered in the drilling of a well.

Conventionally, well pressure control equipment may include a blowout preventer (BOP) stack that sits atop of a wellhead. The BOP stack may include ram BOP(s) and an annular BOP. An annular preventer is a large valve used to control wellbore fluids. In this type of valve, the sealing element resembles a large rubber doughnut that is mechanically squeezed inward to seal on either pipe (drill collar, drillpipe, casing, or tubing) or the openhole. The ability to seal on a variety of pipe sizes is one advantage the annular preventer has over the ram blowout preventer. Most BOP stacks contain at least one annular preventer at the top of the BOP stack, and one or more ram-type preventers below.

Above the annular BOP is often a managed pressure drilling/underbalance drilling rotating control device (RCD)/rotating head. The RCD/rotating head is a pressure-control device used during drilling for the purpose of making a seal around the drillstring while the drillstring rotates. Essentially, the RCD/rotating head is a diverter with holding pressure capability. This device is intended to contain hydrocarbons or other wellbore fluids and prevent their release to the atmosphere by diverting flow through an outlet below the sealing element.

SUMMARY OF DISCLOSURE

In one or more embodiments, a pressure control device may include a body having a central axis extending therefrom; at least one rotatable seal within the body, the rotatable seal configured to seal against a tubular extending through the pressure control device along the central axis and rotate within the body with the tubular; at least one coil within the body wrapped at least once around the central axis, wherein the at least one coil is configured to send characteristics of the tubular to a controller; an outlet to divert fluid from an annulus, wherein the outlet being located axially below the at least one rotatable seal, wherein the controller is configured to control the at least one rotatable seal and its engagement against the tubular based on the characteristics of the tubular received by the controller In one or more embodiments, a method for using a pressure control device may include moving a tubular through at least one rotatable seal in the pressure control device about an central axis of the pressure control device; detecting characteristics of the tubular from within the pressure control device as the tubular moves axially through the pressure control device; sealing off an annulus around the tubular with the pressure control device in response to the detected characteristics by actuating at least one rotatable seal around the tubular to be sealingly engaged with the tubular as the tubular is rotated; and directing fluid from the annulus around the tubular out of the pressure control device.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 2:
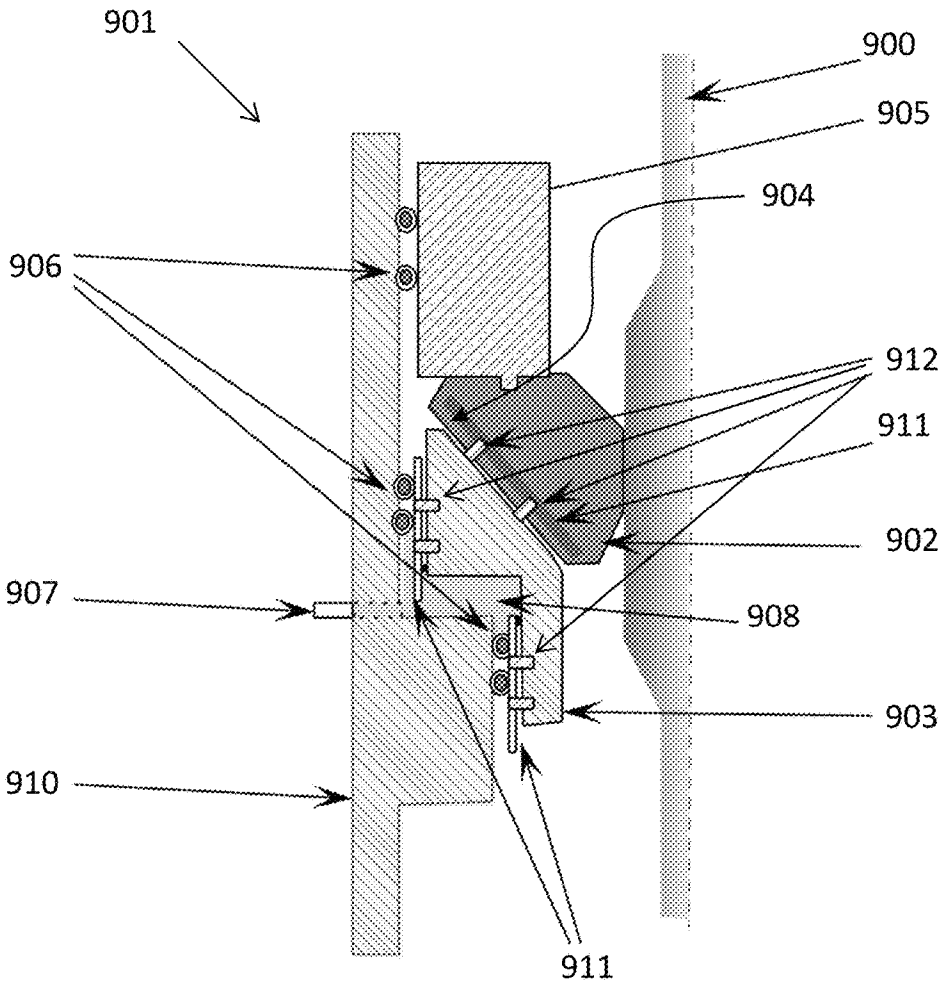
FIG. 2 illustrates a cross-sectional view of pressure control device according to one or more embodiments of the present disclosure.

Embodiments of the present disclosure are described below in detail with reference to the accompanying figures Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

One or more embodiments relate to a smart automated managed pressure drilling/underbalanced drilling rotating control device (RCD)/rotating head, optionally integrated with a well control annular blowout preventer. The integrated device may be referred to as a rotating annular preventer (RAP), and the intelligent rotating annular preventer may be referred to as an intelligent RAP or I-RAP. The functionality of the I-RAP may be automated and controlled intelligently by a controller such as a programmable logic controller (PLC). For example, the RCD or I-RAP may include several sensors to increase the quality and duration efficiency of the sealing onto the tubular. These measurements are fed to the PLC which controls the RCD or I-RAP operation. The control of the sealing engagement of the RCD or I-RAP against a tubular may be based on characteristics of rotatable seal and/or tubular passing therethrough that are transmitted to the PLC. For example, the optimum sealing pressure to seal against the tubular may be determined (and used) based on the diameter and/or location of the portion of the drill string (tubular body, joint, etc.) or bottom hole assembly (BHA) passing therethrough against which the seal will engage.

In one or more embodiments, the I-RAP may divert fluid, seal off the annulus while tubulars are moving up and downwards and/or rotating, seal off the wellbore when there is no any tubulars in it, and/or strip in and out the tubulars in well control situation, and provide for the sealing in an intelligent and/or automated manner. The I-RAP can be used on and off while drilling through different formations and depths when is needed, or tripping in and out or stripping in and out while securing the well. The I-RAP as one single equipment may be installed at the top of the BOP stack, in the place of a conventional annular preventer, with a bell nipple being installed at the top of the I-RAP. However, as mentioned, the present disclosure is not limited to an integrated rotating annular preventer but may apply equally to a rotating control device used in managed pressure drilling or underbalanced drilling.

Additionally, when the present device is not needed, it may be fully opened by applying hydraulic pressure to reposition its piston allowing the retraction/repel of the seals from the tubular. In the fully open position, clearance and internal diameter of the device will at allowing easy passage of the tubulars without any restriction, such as providing the same or similar clearance as the ram BOP stack. When the device is needed, its piston will move to the closed position, and cause the seals to squeeze inward towards any object (or itself for the I-RAP) in order to completely seal off the annulus or even open wellbore (when the I-RAP is used). The I-RAP can be mechanized and automated to fulfill all the required tasks from health monitoring and preventive maintenance, all the way to operation and well construction.

In one or more embodiments, the sealing pressure of the device can be adjusted and regulated automatically, by the controller, for passing different shape of tubulars under variety of wellbore pressures. That is, when different geometry of tubulars are passing through the sealed elements under different wellbore conditions, the pressure of the hydraulic oil system can be adjusted and regulated automatically to ensure the proper sealing of the annulus. Thus, for example, to prevent undesirable pressure variations, nitrogen pre-charged surge accumulator/storage/bottles can be added to the system. Some methods/techniques or hardware can be used to lubricate the tubulars even with the mud, while stripping into the wellbore to minimize the wear on the seals.

Figure 1:
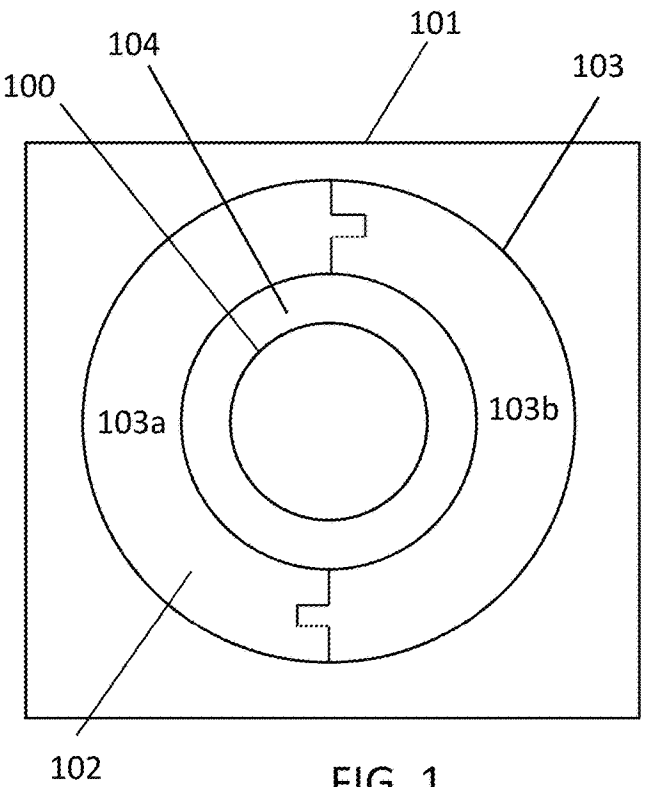
FIG. 1 illustrates a cross-sectional view of a pressure control device according to one or more embodiments of the present disclosure.

Referring now to FIG. 1, a packing assembly according to one or more embodiments is shown. Specifically, as shown, a packing assembly 102, which creates a seal in the pressure control device 101 (which may be an RCD or I-RAP in various embodiments), includes two or more sealing elements (103*a* and 103*b*) that interlock to form a general donut shape 103. A center void space or opening 104 of the donut shape 103 allows a tubular 100 to pass through. The interlock sealing elements (a and b) allows the diameter of the center opening 104 to be adjustable without losing the sealing capability, thereby allowing for sealing engagement against different sized tubulars or other drill string components. Additionally, while not shown, it is intended that the interlocking sealing elements 103*a*, 103*b* may include metallic inserts molded therein that may reinforce the elastomeric material of the interlocking sealing elements 103*a*, 103*b*. Further, it is also intended that the outer surface of the elastomeric material of interlocking sealing elements 103*a*, 103*b* may selected to have a coefficient of friction to aid in reducing wear of the sealing elements. Additionally, a lubrication system (see FIG. 23) may be used to aid in reducing the wear on the sealing elements.

Referring to FIG. 2, a pressure control device 901 is shown. As shown, in one or more embodiments, an pressure control device 901 (which may be an I-RAP, for example) has an outer body 910 which houses a sealing element 902 that closes around and seals against a tubular 900. As shown, tubular 900 may have a varying diameter; the joint or connection between two tubulars may have a greater diameter than the tubular body. According to the present disclosure, the pressure control device may vary the sealing engagement of the sealing element 902 depending on the portion of tubular 900 being passed therethrough to maintain a substantially constant sealing pressure or force exerted on the tubular 900. Those skilled in the art would appreciate that the tubular 900 may be any string of tubulars that connect end-to-end such as, but not limited to, drill pipe string. Further, it is also understood that the BHA may pass therethrough and may also include other, non-cylindrical components such as stabilizers, reamers, spiral collars, etc.

Sealing element 902 seals around the tubular 900 upon actuation by an axially moving piston 903 that interfaces and engages with sealing element 902 at slant surface 904. The slant surface 904 of the axially movable piston 903 that is in contact with the sealing element 902 may have a low friction coefficient (such as by coating or other surface treatment) to reduce wear of the sealing element 902 over time as it slides relative to the piston 903 as the piston moves axially to open/close the pressure control device 901. In one or more embodiments, the slant surface 904 of the axially movable piston 903 is rotationally coupled, due to a plurality of guide tracks 911 and a plurality of guides 912 that move within guide tracks 911, with the sealing element 902 so that the piston 903 rotates with the tubular 900 and sealing element 902. A cylindrical sleeve 905 may be attached to an upper surface of the sealing element 902 (such as through one or more fingers that extend into sealing element 902) such that the cylindrical sleeve 905 and the sealing element 902 rotate as one body. A plurality of bearings 906 (such as thrust bearings) can be disposed between the cylindrical sleeve 905 and the outer body 910 and/or the axially movable piston 903 and the outer body 910. The plurality of bearings 906 allows relative rotational movement between the cylindrical sleeve 905 and the outer body 910 and/or the axially movable piston 903 and the outer body 910. Furthermore, the pressure control device 901 has a hydraulic fluid inlet 907 (through the outer body 910) that feeds into a chamber 908 filled with hydraulic fluid. The fluid flow into and out of the chamber 908 axially moves the piston 903, thereby causing/retracting sealing engagement with the tubular 900. Further, in one or more embodiments, the hydraulic fluid inlet 907 allows a pressure of a hydraulic oil in the chamber 908 between the axially movable piston 903 and the outer body 910 to be controlled by a controller (not shown). In addition to the hydraulic actuation of piston 903, a wellhead pressure (not shown) may be used to assist the movement of the axially movable piston 903, in one or more embodiments.

As mentioned above, it may be desirable to determine the size of the tubular (or other component) that will be passing through the device so that the sealing element(s) can be actuated in the optimum compromise between sealing and wear during axial movement of the tubular within the pressure control device. In one or more embodiments, such detection may only have to be a relative determination in order to determine the variation in the tubular or component diameters passing therethrough that may include, for example, a tool joint of a tubular, a central section of heavy-weight tubular, and the top of the bottom hole assembly (BHA). It may also be desirable to determine the centralization of the tubular inside the pressure control device to ensure proper closing of device onto the tubular (especially if the tubular has a small diameter). Such detection may also guide prediction of additional local wear of the sealing element(s) when closed onto a tubular that is located out of center. For example, this situation may occur when the rig and its top drive is not properly aligned onto the well-head and BOP, which can cause an off-axis position of the tubular inside the pressure control device. In such situation, it is understood that the elasticity of the sealing element may allow for sealing to occur, but more contact stress (and wear) would be present on one side of the sealing element than would exist for a properly aligned tubular.

Further, the set of measurements for tubular sizing may also allow for the recognition of "non-cylindrical" surfaces which can be, for example, a stabilizer on stabilizer, a reamer, or a spiral collar, which are mainly contained in the BHA. As such components pass through the device, particular procedures may be undertaken. For example, in one or more embodiments, the BOP pipe-ram may be closed on a lower section of the tubular assembly, while opening the pressure control device of the present disclosure and stripping the tubular assembly linearly through the BOP assembly. However, in one or more embodiments, it is also envisioned that the pressure control device of the present disclosure may contain multiple sealing elements that are axially spaced from each other, allowing for sequential opening/closing to pass the non-cylindrical parts through the device while maintaining a seal. Finally, one or more embodiments of the present disclosure may also estimate surface roughness to allow for the adaptation of the hydraulic force applied onto the sealing element(s), which in turn defines the contact pressure between the sealing element(s) and the surface of the tubular (to mitigate potential wear of the sealing element).

In one or more embodiments, electro-magnetic sensing may allow for the determination of such characteristics described above FIG. 3 describes the basic principle, of one possible implementation, of using two coils: a TX coil 1002 for transmit and a RCV coil 1003 for reception. Such coils 1002, 1003 can be obtained by wrapping several turns of wire around a central axis 1004. An electrical response of such coils 1002, 1003 may be affected by the presence (proximity) of a metallic element, such as a ferromagnetic tubular 1000, passing through the coils 1002, 1003. The TX coil 1002 is fed by an AC current "I" 1005 and generates magnetic flux "H" which propagates magnetic lines 1006. This AC magnetic flux/lines 1006 generates magnetic flux "Φ" in the ferromagnetic tubular 1000. In order to find the magnetic flux "Φ", the following two equations can be used:

$$\beta=\mu H=\mu N1I \quad \text{(Equation 1)}$$

where β=magnetic flux density, H=magnetic field, μ=Magnetic permeability, I=TX current, and N1=number of turn on TX coil $$\Phi=\int^{S}\beta\partial s \quad \text{(Equation 2)}$$

where Φ=magnetic flux, and S=the section inside the winding.

Furthermore, it is noted that only the ferromagnetic section is considered as $\mu_{ferromagnetid\text{-}metal}>>\mu_{Air}$. In reality, the value of the magnetic flux Φ depends on the overall magnetic reliance over the magnetic loop, including the part of the path 1011 outside ferromagnetic material (i.e., the fluid between the tubular 1000 and the pressure control device and BOP body) as well as the part of the path through other ferromagnetic body 1007 (surrounding body of pressure control device of present disclosure and BOP). At the RCV coil 1003, the presence of the AC magnetic flux creates a AC voltage difference "V" 1008, thus creating equation 3:

$$V=-\delta\Phi/\delta t \quad \text{(Equation 3)}$$

Figure 3:
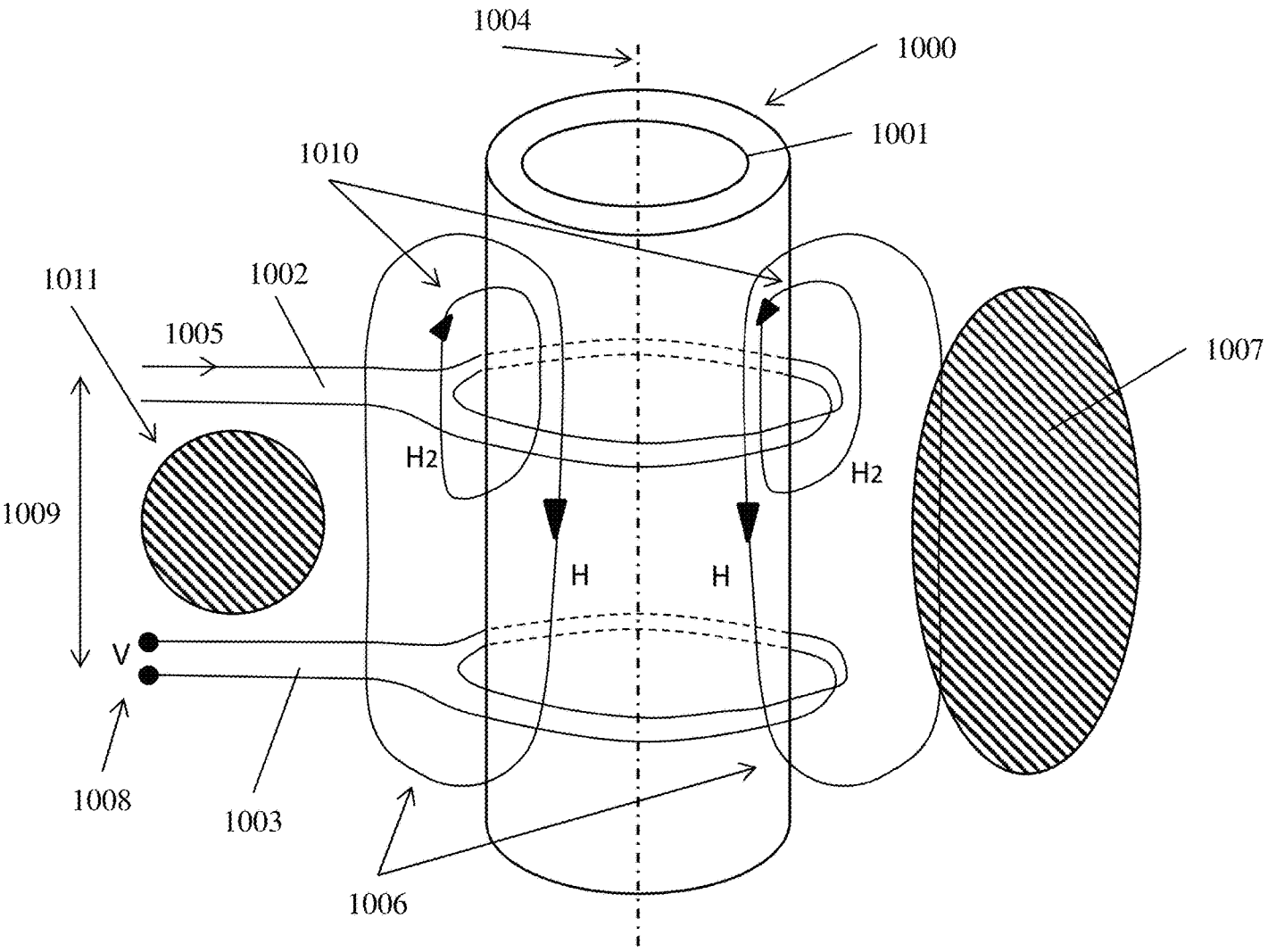
FIG. 3 illustrates a side view of use of coils in detecting tubulars according to one or more embodiments of the present disclosure.

The AC magnetic flux Φ depends on a ferromagnetic section 1001 of the tubular 1000. The AC magnetic flux Φ passes through the RCV antenna 1003 and creates a voltage 1008 proportional to the AC magnetic flux Φ. It should be noted that this voltage 1008 is 90 degrees out of phase from the AC current 1005 in the TX antenna 1002. Thus, the amplitude of voltage 1008 is dependent on the ferromagnetic section 1001 of the tubular 1000. The distance 1009 affects the amount of magnetic flux "$H_2$" 1010 which leaks out of the TX coil 1002 and loops back without passing into the RCV coil 1003. In view of the above, one skilled in the art would appreciate how these coils 1002, 1003, as seen in FIG. 3, allow for the estimation of the variation of the ferromagnetic section 1001 of the tubular 1000 crossing the coils 1002, 1003.

Figure 4:
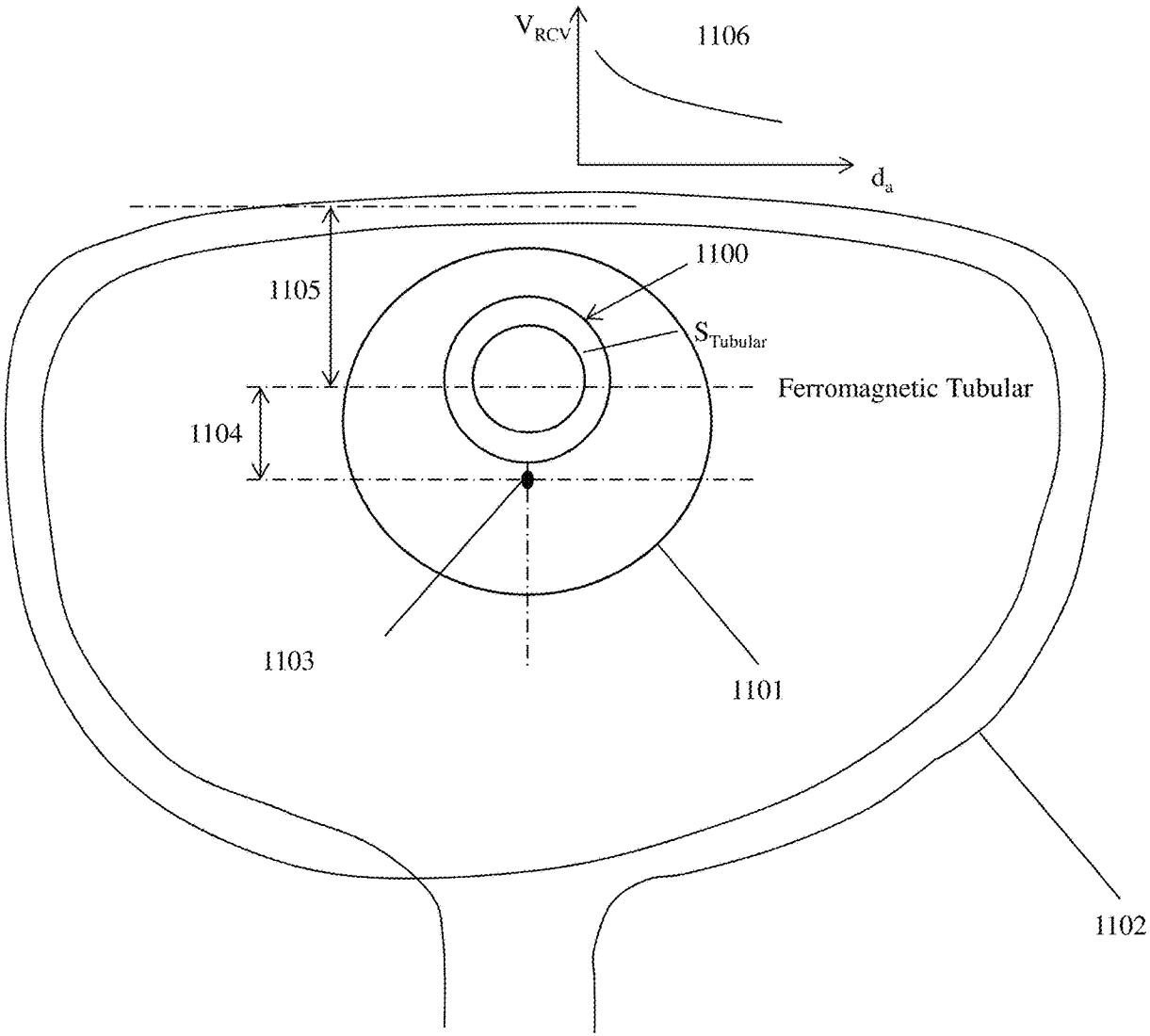
FIG. 4 illustrates a top view of use of coils in detecting tubulars according to one or more embodiments of the present disclosure.

As mentioned above, embodiments of the present disclosure may also consider the symmetry of the tubulars passing through the pressure control device. The consideration and detection of such misalignment or asymmetry may be observed from FIG. 4. As shown in FIG. 4, the ferromagnetic tubular 1100 may be kept by some guidance 1101 geometry (such as the body of the pressure control device itself) closer to one side of an coil 1102 than the other. With such coil 1102, the detected voltage (discussed above) will depend on the position of the ferromagnetic tubular 1100 versus a guidance center 1103 (distance "$d_g$" 1104). The magnetic flux in the ferromagnetic tubular 1100 will depends strongly on a distance to the closest coil 1102 (wiring distance "$d_a$" 1105). Thus, the voltage output V of the RCV coil 1003 (shown in FIG. 3) decreases with an increasing wiring distance "$d_a$" 1105 for a given ferromagnetic tubular 1100. Additionally, it is noted that the "non-symmetry" of the coil 1102 is exaggerated for purpose of explanation. In practice, it is envisioned that the non-symmetry can be obtained by using a circular coil larger than the diameter of the guidance 1101 installed with its center shifted from the guidance center 1103.

Figure 5:
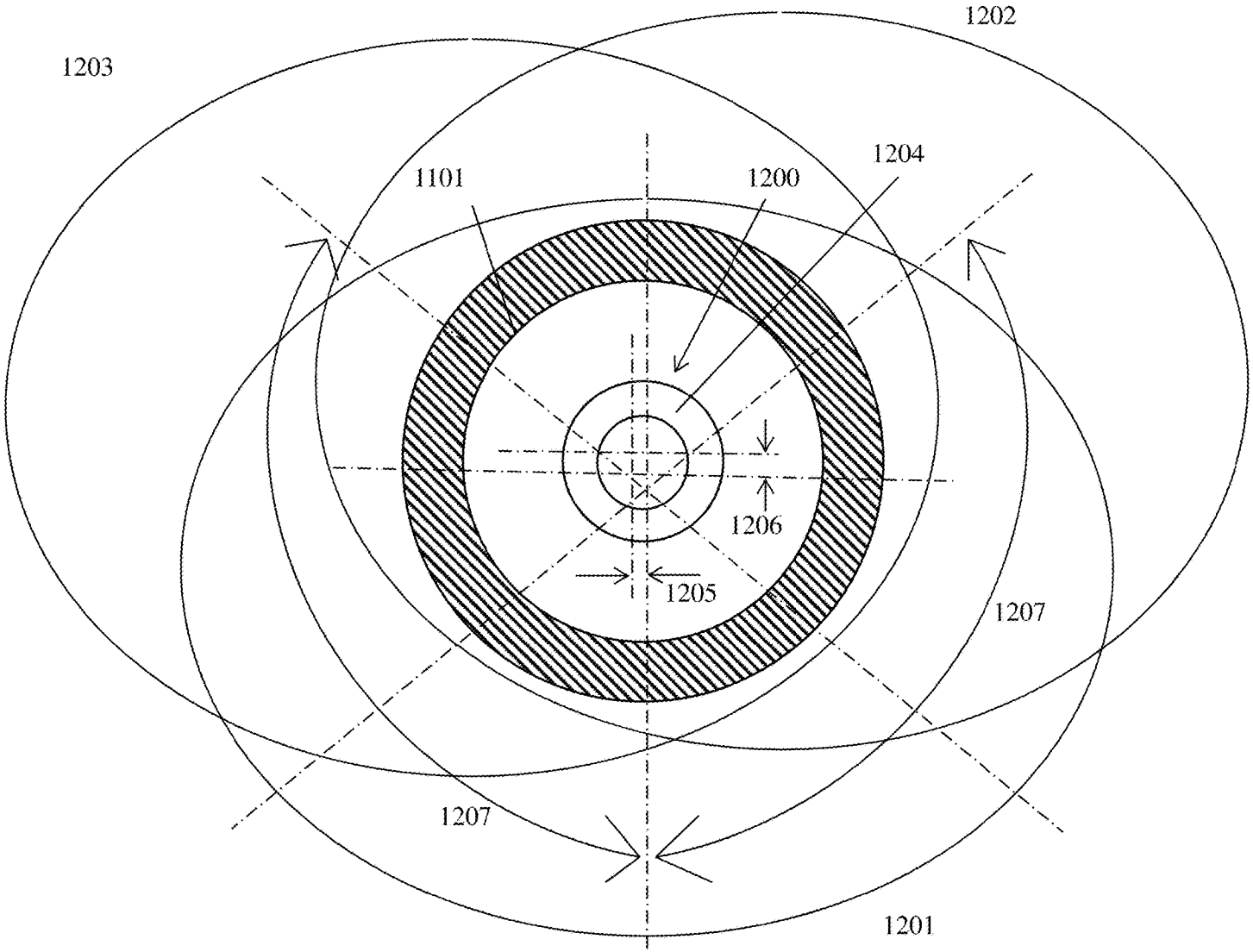
FIG. 5 illustrates a top view of use of coils in detecting tubulars according to one or more embodiments of the present disclosure.

Also discussed above was the determination of relative diameter or size of a tubular passing through a pressure control device. Now referring to FIG. 5, FIG. 5 shows a combination of three coils 1201, 1202, 1203 which allow for the determination of the relative size of a section 1204 of a ferromagnetic tubular 1200 as well as its position. From coils 1201, 1202, 1203, the following parameters can be determined: the section S inside the winding 1204, the position of the tubular relative to the x-axis $X_t$ 1205, and the position of the tubular relative to the y-axis $Y_t$ 1206. Each coil 1201, 1202, 1203 in fact corresponds to a pair of TX coil and RCV coil. In FIG. 5, the three pairs of coils 1201, 1202, 1203 are shifted by 120 degrees 1207. Thus, to allow simultaneous measurement, each pair of coils 1201, 1202, 1203 may be operated at a different frequency and then a specific band-pass filter (not shown) is connected to the RCV coil of coils 1201, 1202, 1203. In turn, specific calibration versus tubular section and position may allow definitive determination of the tubular section and position.

Furthermore, it is understood that the non-symmetrical coils 1002, 1003 of FIG. 4 may also be sensitive to the non-symmetry of a ferromagnetic tubular 1300. In one or more embodiments, the coils may be used to determine that the ferromagnetic tubular passing through the pressure control device is not symmetrical enough for the device to be able to form a seal on the external surface of the ferromagnetic tubular 1300. Such situation would be present with a stabilizer, a reamer, or a spiral collar.

Figure 6:
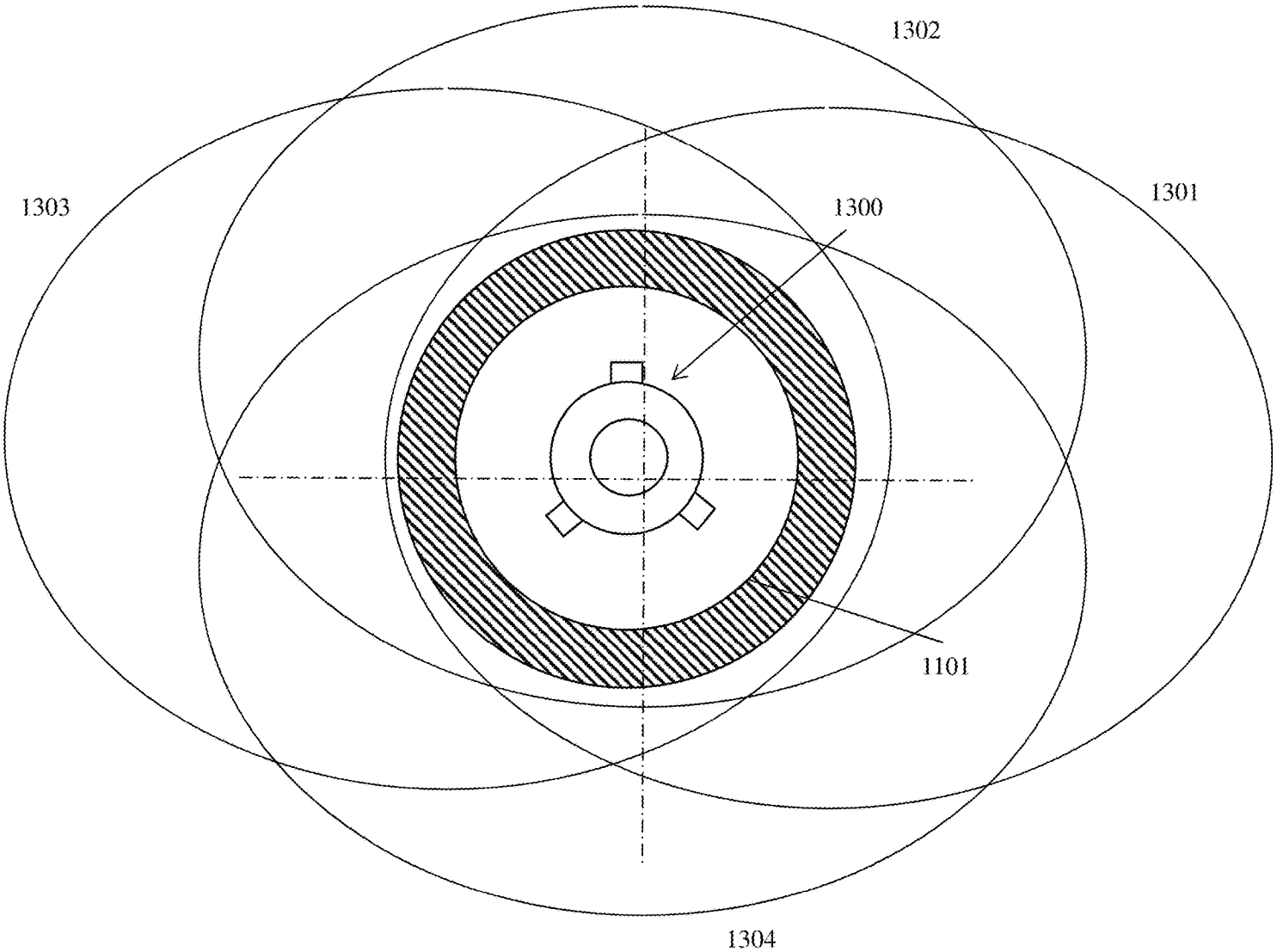
FIG. 6 illustrates a top view of use of coils in detecting tubulars according to one or more embodiments of the present disclosure.

Referring now to FIG. 6, another embodiment of use of coils to measure the tubular characteristics (particularly a non-cylindrical tubular) is shown. The combination of pairs of non-symmetrical coils 1301, 1302, 1303, 1304 is shown in FIG. 6. These four pairs of coils 1301, 1302, 1303, 1304 ensure proper recognition of: the position of the center of the tubular (shown as 1205 and 1206 in FIG. 5), the average outside diameter of the tubular 1300, and the relative non-symmetricality of the ferromagnetic tubular 1300. The coefficient of "non-symmetricality" may be a function of discrepancies of measurements between the pairs of coils 1301, 1302, 1303, 1304. The coefficient of "non-symmetricality" value may be "1" for full circular condition and "0" for thin fat surface. Other processing may give an estimated of the variation of the tubular radius versus the azimuth within the tubular, as well.

Figure 7:
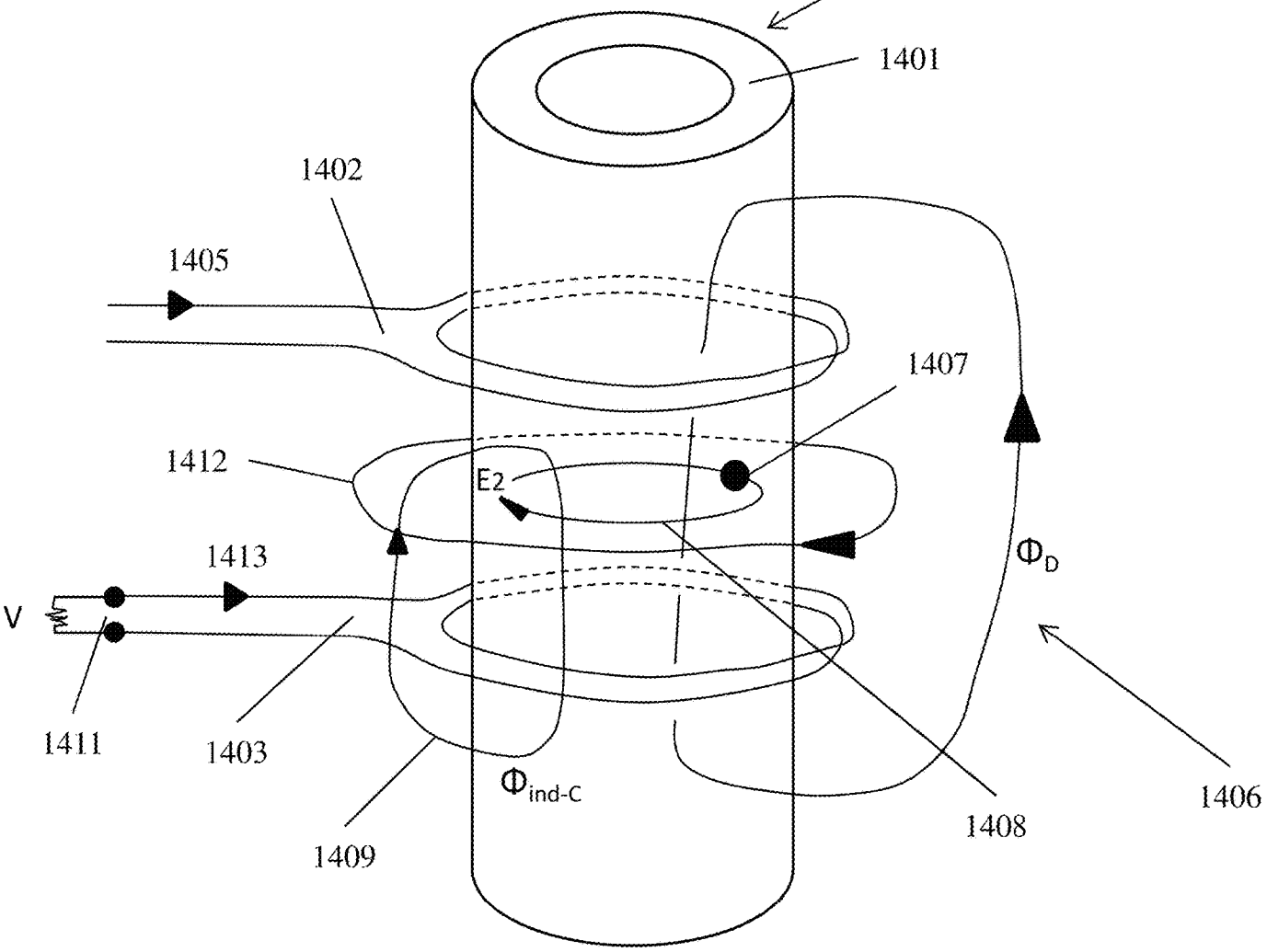
FIG. 7 illustrates a side view of use of coils in detecting tubulars according to one or more embodiments of the present disclosure.

When considering the pair of coils (shown as 1002 and 1003 in FIG. 3), an additional measurement can be obtained by considering the phase of the received signal versus the transmit signal. This consideration is similar to the phase measurement of induction logging tool and is shown is FIG. 7. In FIG. 7, a current "I" 1405, which is fed into a TX coil 1402, generates the magnetic flux "$\Phi_D$" 1406 (Flux direct). Thus, current "I" 1405 and the magnetic flux "$\Phi_D$" 1406 are in phase. As the magnetic flux "$\Phi_D$" 1406 passes through each section 1401 of the ferromagnetic tubular 1400, some electromotive force "$E_2$" 1408 appears in such section 1401, thus creating equations (4)-(6):

$$E_2=-\delta\Phi_D/\delta t \quad \text{(Equation 4)}$$

$$\text{If we considered } \Phi_D=K1\cos(\Omega t) \quad \text{(Equation 5)}$$

$$\text{Then } E_2=-K2\Omega\sin(\Omega t) \quad \text{(Equation 6)}$$

These equations shows that the electromotive force "$E_2$" 1408 is out of phase versus the magnetic flux "$\Phi_D$" 1406 and the current "I" 1405 by 90 degrees. Due to the electromotive force "$E_2$" 1408, a current "$I_{ind\text{-}tub}$" 1407 is generated. The current "$I_{ind\text{-}tub}$" 1407 generates induced flux "$\Phi_{ind\text{-}C}$" 1409 which is in phase with the electro-motive force "$E_2$" 1408. A RCV coil 1403 is submitted to two fluxes: the magnetic flux "$\Phi_D$" 1406 (in phase with current "I" 1405) and induced flux "$\Phi_{ind\text{-}C}$" 1409 (90 degrees phase with current "I" 1405). These two fluxes create the voltage "V" 1411 at the output of the RCV coil 1403 which has an additional phase of 90 degrees versus the current "I" 1405. In practical construction, some additional induced current "$I_{ind\text{-}str}$" 1412 and induced flux "$\Phi_{ind\text{-}str}$" (not shown) appears in the metallic structure of the pressure control device and BOP. The induced flux "$\Phi_{ind\text{-}str}$" (not shown) may be in phase with the induced flux "$\Phi_{ind\text{-}C}$" 1409, and also influences the RCV coil 1403.

Furthermore, the phase of the voltage "V" 1411 at the RCV coil 1403 has a phase between 90 and 180 degrees versus current "I" 1413. This phase allows for the determination of the importance of the current "$I_{ind\text{-}tub}$" 1407, which allows for the characterization of the current flowing in the tubular. This current is affected by the skin effect which pushes the current flow near an external surface of the ferromagnetic tubular 1400. The skin depth is as follows:

$$\delta=\sqrt{\frac{1}{\pi f\sigma\mu 0\mu r}} \quad \text{(Equation 7)}$$

where f is frequency, μ0 is magnetic permeability of free space, μr is relative permeability, and σ is conductivity.

The skin depth "δ" is a measure of the depth at which the current density falls to 1/e of its value near the surface. Over 98% of the current may flow within a layer four times the skin depth from the surface.

As mentioned above, one or more embodiments may involve detection of surface defects in or non-cylindrical geometries of tubulars passing through a pressure control device. Thus, FIG. 8 the difference in the induced current "$I_{ind\text{-}str}$" 1412 for three different tubulars. In geometry A, a current flow 1502 is in a cylindrical tubular 1500 along an external surface 1501, and a graph 1503 shows the current density distribution. With increased frequency, more current flows even closer to the external surface 1501. Thus, the current flow 1502 is affected by the surface physical conditions. In geometry B, a plurality of surface scratches 1504 and/or a plurality of surface grooves 1505 are axially along a wall 1506 of a tubular 1507. These surface defects 1504, 1505 impose that a current flow 1508 makes a longer path, thereby opposing more resistance to the current flow 1508 so that less current is generated. This effect can be detected by the phase measurement of the RCV coil. In one or more embodiments, with such processing, axial surface defects in the range of 1 millimeters or less can be detected by an EM coil (not shown). Finally, in geometry C, a tubular 1509 with special external shape 1511 (such as a stabilizer or reamer) is shown. In such tubular 1509, a current flow 1510 also has a longer path and so less current would appears due to the additional path resistance. Such effect can also be detected by the RCV coil. Additionally, geometry B can be differentiated from geometry C by performing measurement of V (discussed in FIG. 7) at the RCV coil (shown in FIG. 7) for different frequency of the currents 1508, 1510 because there will be less of a frequency in geometry C than in geometry B. In one or more embodiments, drive frequency (not shown) may be in the range of 5 to 20 Kertz, or even up to 100 Khertz. In this case, for example, the drive frequency may be pushed up to 2 MHertz.

Figure 9:
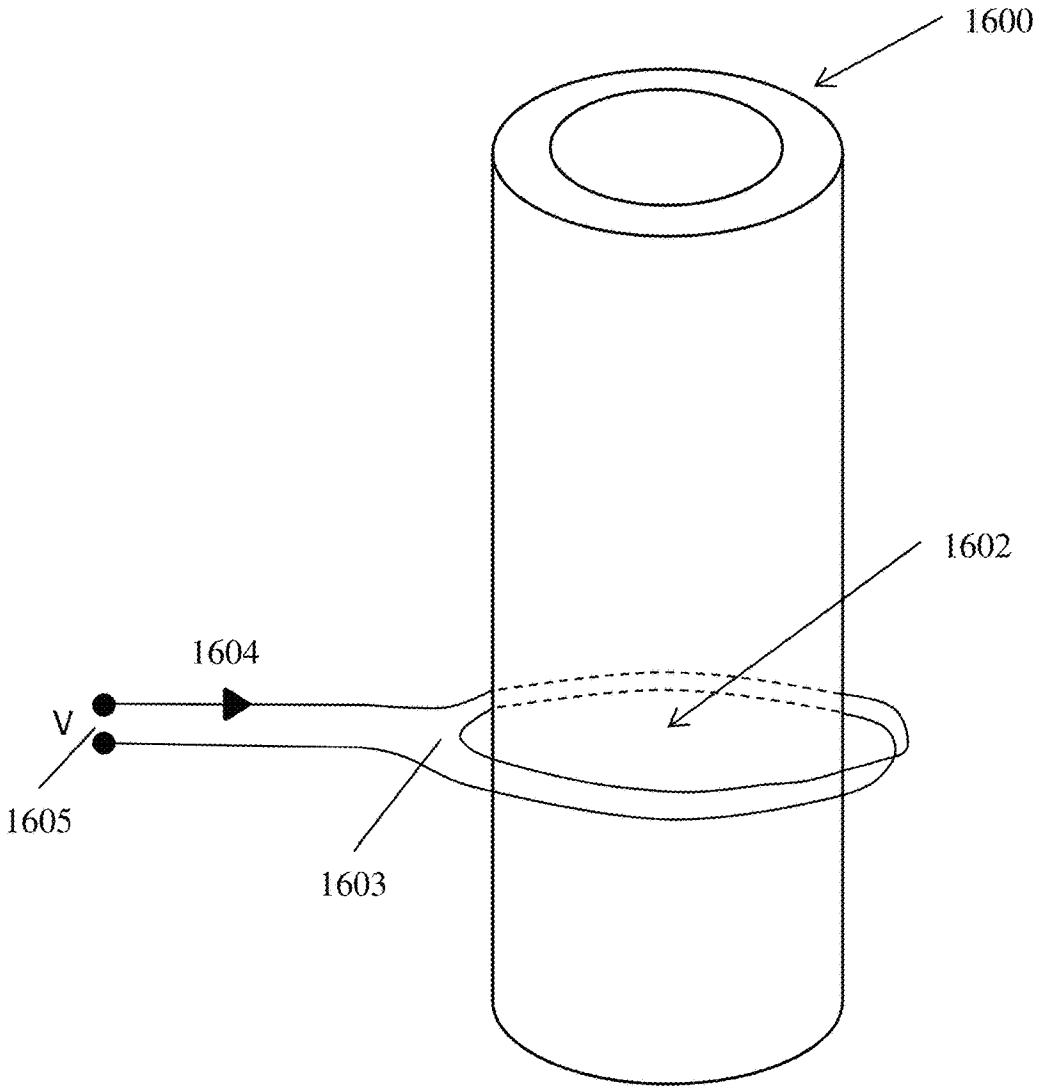
FIG. 9 illustrates a top view of use of coils in detecting tubulars according to one or more embodiments of the present disclosure.

While the above embodiments describe the use of pairs of coils, the present disclosure is not so limited. Rather, now referring to FIG. 9, FIG. 9 describes the usage of a single coil 1603 in place of a pair of coil (TX and RCV) around a ferromagnetic tubular 1600. In such case, a inductance of the coil 1603 is affected by a presence of metallic structures 1602 inside and/or outside the coil. The inductance can be considered from equations (8) and (9):

$$V=-L\delta i/\delta t \quad \text{(Equation 8) and}$$

$$L=\mu 0\mu r\ N^2A/l \quad \text{(Equation 9)}$$

where μ0 is magnetic permeability of free space, μr is relative permeability, N is number of turn(s) in coil, A is the section of the coil, and l is the axial length of the coil.

In such scenario, the coil 1603 may be driven a set current "I" 1604 (amplitude and frequency). The voltage "V" 1605 is measured, and the apparent inductance can be deduced as ratio V/I. From the apparent inductance, all the measurements described above can be deduced.

Figure 10:
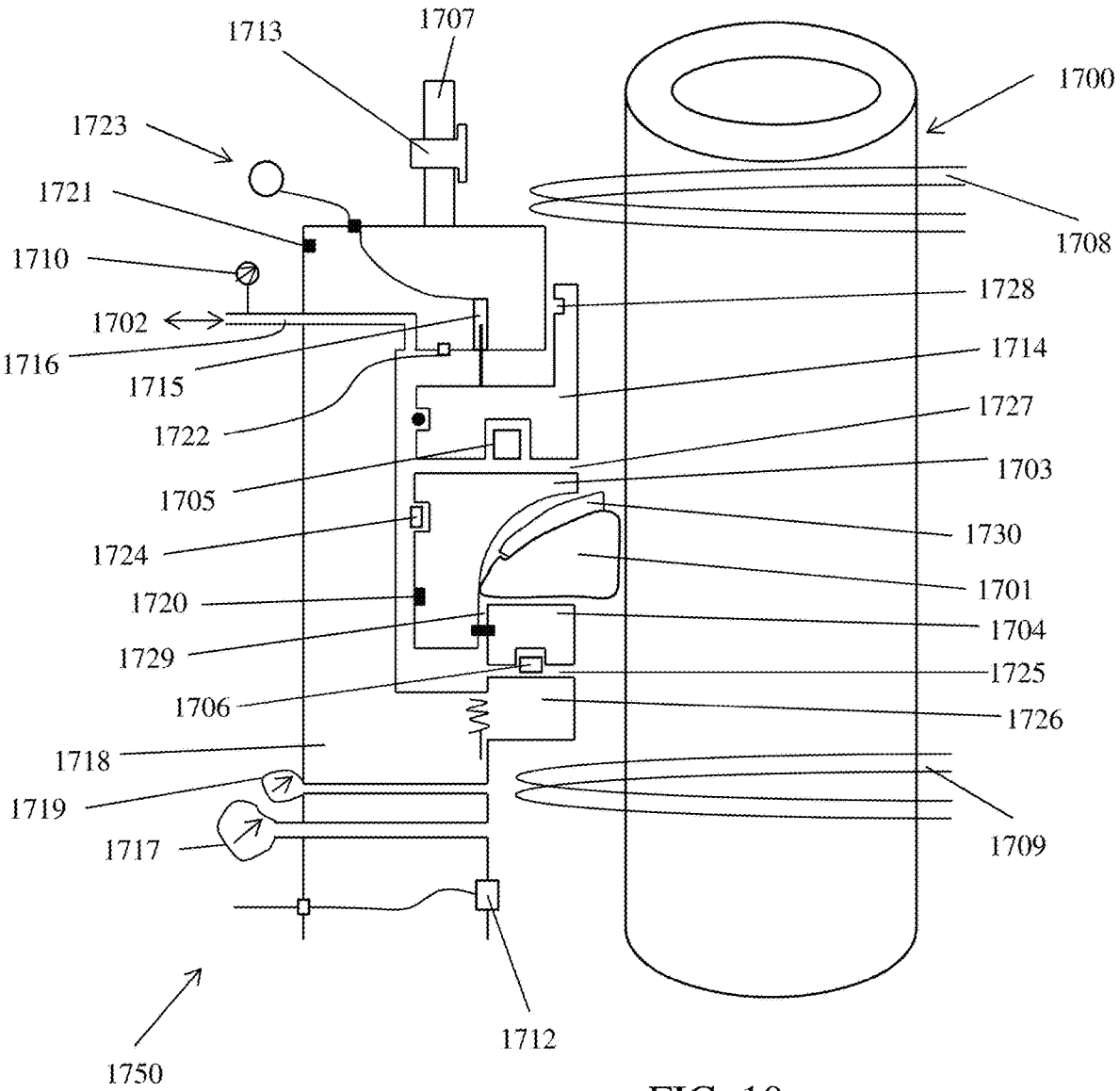
FIG. 10 illustrates a cross-sectional view of a pressure control device according to one or more embodiments of the present disclosure.

Referring now to FIG. 10, an implementation of the coils in a pressure control device of the present disclosure is shown. Specifically, FIG. 10 shows a pressure control device 1750 having a body 1718 that houses, among pressure control components, various sensors. Pressure control device 1750 includes (within its body 1718) at least one sealing element 1701 that is reinforced by a metal tool 1730. The actuation of sealing element 1701 is obtained by feeding an oil or other hydraulic fluid 1702 above a non-rotary activation piston 1714. The non-rotary activation piston 1714 axially moves itself and rotary compression system 1703. When moved by piston 1714, rotary compression system 1703 compresses sealing element 1701 between it and a rotary support 1704. While piston 1714 does not rotate, the rotary compression system 1703, the rotary support 1704 and the sealing element 1701 rotate with a tubular 1700 that extends through the pressure control device 1750. The rotary compression system 1703 and the rotary support 1704 are decoupled for rotation by a thrust bearing 1705 and a rolling bearing 1706. Additionally, a radial bearing 1724 may be disposed on the rotary compression system 1703 to aid in moving the rotary compression system 1703 against the body 1718. Also illustrated the embodiment shown in FIG. 10 are multiple seals that are provided between various components. For example, a high pressure rotary seal 1725 may be located between a fixed support 1726 and the rotary support 1704; a sliding seal 1729 may be located between the rotary support 1704 and the rotary compression system 1703; a low pressure rotary seal 1727 may be located between the non-rotary activation piston 1714 and the rotary compression system 1703; and a set seal 1728 may be located between the non-rotary activation piston 1714 and the body 1718.

As discussed herein, the pressure control device may detect characteristics of the tubular as well as sealing element (that seal against the tubular). Thus, in one or more embodiments, an upper-set of coils 1708 is installed above the pressure control device 1750 and below the bell nipple 1707. A lower set of coils 1709 is installed at a bottom end of the pressure control device 1750. Further, these two sets of coils 1708, 1709 may include multiple coils as described above (as in FIG. 5 or 6). Thus, the two independent sets of coils 1708, 1709 are able to detect a tubular connection (i.e., change in outer diameter/shape) reaching the pressure control device 1750 from either the top or bottom of the device. With such design, the change of tubular shape or size or surface quality may detected so that the oil pressure (measured by an oil pressure gauge 1710) can be adapted for optimum sealing performance of the pressure control device 1750 while limiting the risk of damaging the sealing element 1701.

The embodiment illustrated in FIG. 10 also includes other sensing devices. For example, in one or more embodiments, a linear variable differential transformer (LVDT) 1715 may be incorporated in body 1718 to determine the position of the non-rotary activation piston 1714. Such displacement corresponds to radial deformation of the sealing element 1701 which is squeezed against the tubular 1700. In such construction, the push-force on the sealing element 1701 is primarily imposed by the oil 1702 supplied in an oil chamber 1716. There is a direct relation between the push force and the measured oil pressure from the oil pressure gauge 1710. In one or more embodiments, the push-force on the activation of the sealing element 1701 may be a combination of the force created by the pressurized oils 1702 and an additional push force created by a pressurized mud (not shown) below the pressure control device 1750. This mud effect can be determined based on a pressure gauge 1717 measuring the mud pressure. Furthermore, a mud temperature probe 1719 is also included.

Additionally, a transducer such as a tangent strain gauge 1720 may be installed on the rotary compression system 1703. The tangent strain gauge 1720 measures the compression of the sealing element 1701. The radial contact force between the sealing element 1701 and the tubular 1700 created hoop-stress in this part. When proper placement, the output of the tangent strain gauge 1720 can directly allow one to deduce the contact stress between the sealing element 1701 and the tubular 1700. When tracking these measurements simultaneously, it is possible to determine the behavior of the sealing element 1701 (i.e. how it seals, seal wear and deformations).

In one or more embodiments, pressure control device 1750 may include upper ultrasonic sensors 1713 (for example, above the pressure control device and below bell nipple 1707) and lower ultrasonic sensors 1712 that are proximate a lower end of the pressure control device 1750. In one or more embodiments, ultra-sonic sensors 1712, 1713 may each include several sensors, such as more than three sensors. In one or more embodiments, each ultra-sonic sensor 1712, 1713 are "pulse-echo" sensors which can transmit and receive ultra-sonic pulse. The time of flight of the ultra-sonic pulse is measured by allowing the estimate of travel distance. Also, the amplitude of the received signal is measured. With a set of three sensors distributed around the pressure control device 1750, it may be possible to estimate the diameter and position of the tubular 1700. For accurate determination of the tubular diameter, a sonic speed may be desired; however for determination of the difference of diameter, such accurate knowledge of sonic speed is not mandatory. In fact, the ultra-sonic pulse detection can be affected by a wear band on a tool joint. For example, as the wear band may have an axial extend of 0.5 to 1.5 inches and a thickness between 0.1 to 0.2 inches, the reflected signal returned to the transducer may not be fully in phase over the full surface of the transducer. Thus, the detected time flight may correspond to a weighted time of flight corresponding to the tubular surface and the top of the wear band. The signal amplitude would also be reduced. Thus, the presence of the wear band is detected by ultra-sonic system 1712, 1713; however, true diameter of the wear band may not be determined with as high of an accuracy.

Figure 8:
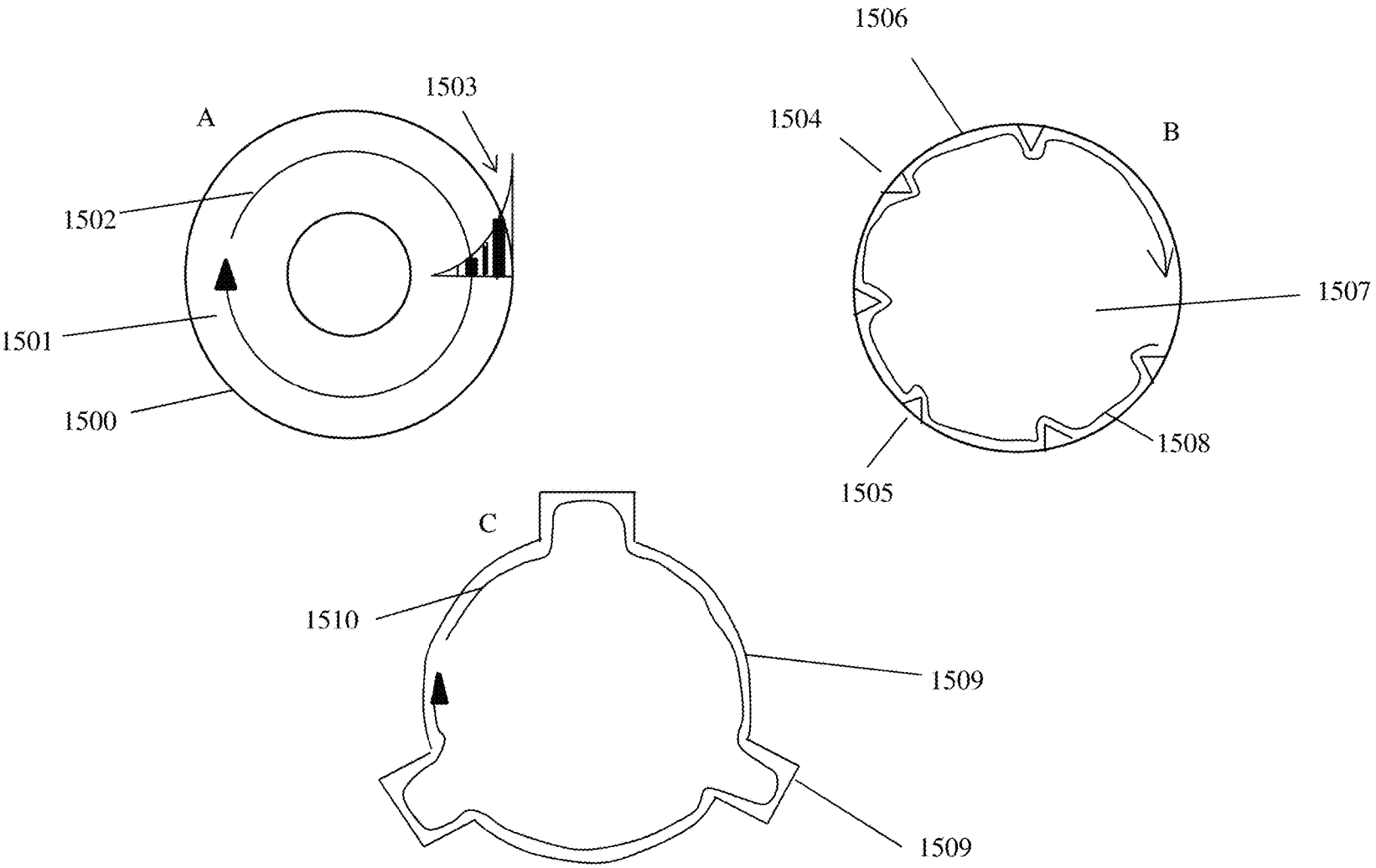
FIG. 8 illustrates current flow in various tubulars according to one or more embodiments of the present disclosure.
Figure 11:
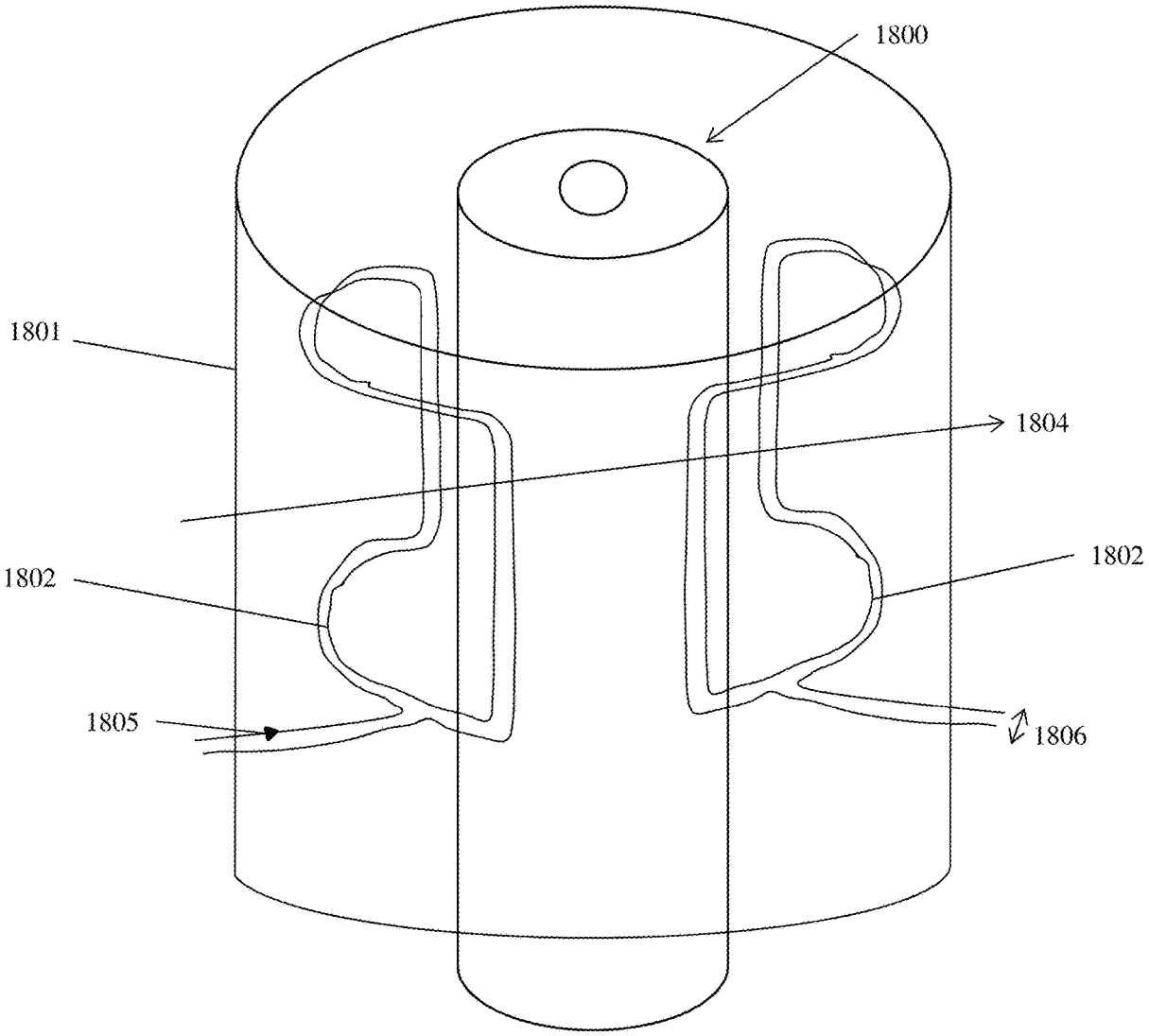
FIG. 11 illustrates a side view of use of coils in detecting tubulars according to one or more embodiments of the present disclosure.

From the amplitude of the received signal by ultra-sonic sensor 1712, 1713, it may be also possible to estimate the surface qualify of the tubular 1700, which may be particularly applicable when the surface defects are in the same order of magnitude as the sonic weave length. In one or more embodiments, the ultra-sonic sensors 1712, 1713 may operate with pulse centralized on frequency between 100 to 300 Khertz. With such processing on signal amplitude, surface defect in order of (several) millimeters can determined. However, if small surface defects (typically less than 1 mm) with radial patterns are on the surface of the tubular, a special radial coil, as shown in FIG. 11, may be installed above and below the pressure control device 1750, similar to the use of radial coil on Schlumberger's LWD Periscope tool. The signal output of the special radial coil would also provide information of non-symmetrical tubular (such as shown in FIG. 8, geometry C). In one or more embodiment, two sets of special radial coil, TX radial coil 1802 and RCV radial coil 1803 may be installed in a pressure control device 1801 (or a bell nipple). Furthermore, a magnetic flux "$\Phi_D$" would be in the direction donated by the arrow 1804 and a current "I" 1805 is fed into the TX radial coil 1802. This creates a voltage "V" 1806 at an output of the RCV radial coil 1803. The configuration of FIG. 11, in one or more embodiments, would allow one to scan a whole surface of a tubular 1800.

Therefore, as shown above, the following characteristic of the tubular can be obtained: the tubular diameter and position can be determined by either coil set (TX and RCV) or ultra-sonic sensor set; large circumferential surface defects (such as wear ring at tool joint) can be determined by the ultra-sonic sensor set; surface defects of a few millimeters (in any direction) on a tubular can be determined by the ultra-sonic sensor set; the axial surface defect of millimeter or less on the tubular can be determined by the coil set (TX and RCV); the circumferential surface defects of less than 1 millimeters can be determined by the set of special radial coils, and the non-cylindrical shape of the tubular can determined by coil sets, as well as special radial coil set and partially by ultra-sonic sensor set.

Figure 14:
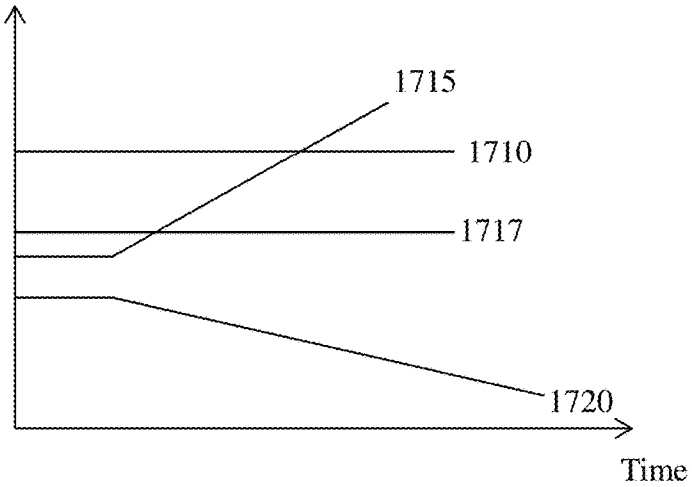
FIG. 14 illustrates a graph of the response of a transducer on a pressure control device according to one or more embodiments of the present disclosure.
Figure 12:
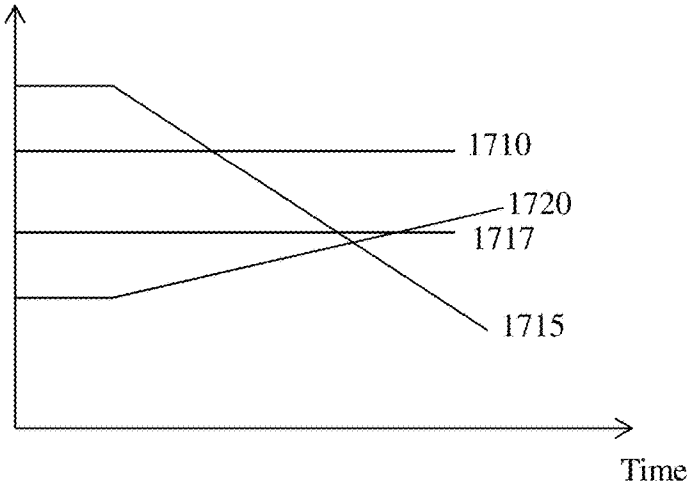
FIG. 12 illustrates a graph of the response of a transducer on a pressure control device according to one or more embodiments of the present disclosure.
Figure 13:
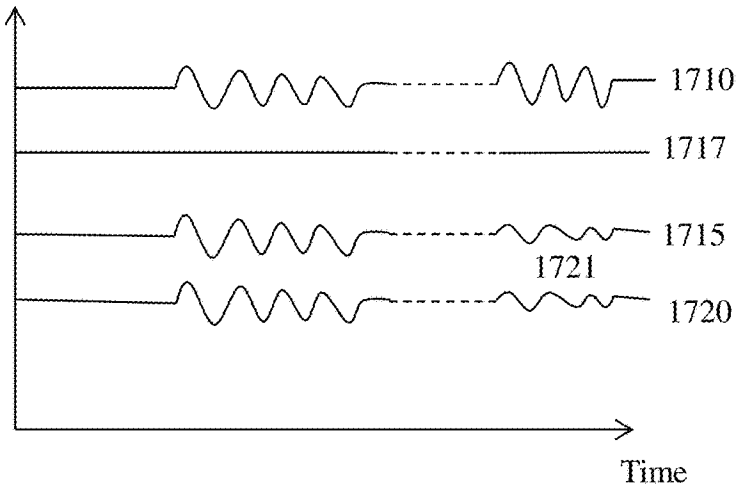
FIG. 13 illustrates a graph of the response of a transducer on a pressure control device according to one or more embodiments of the present disclosure.
Figure 15:
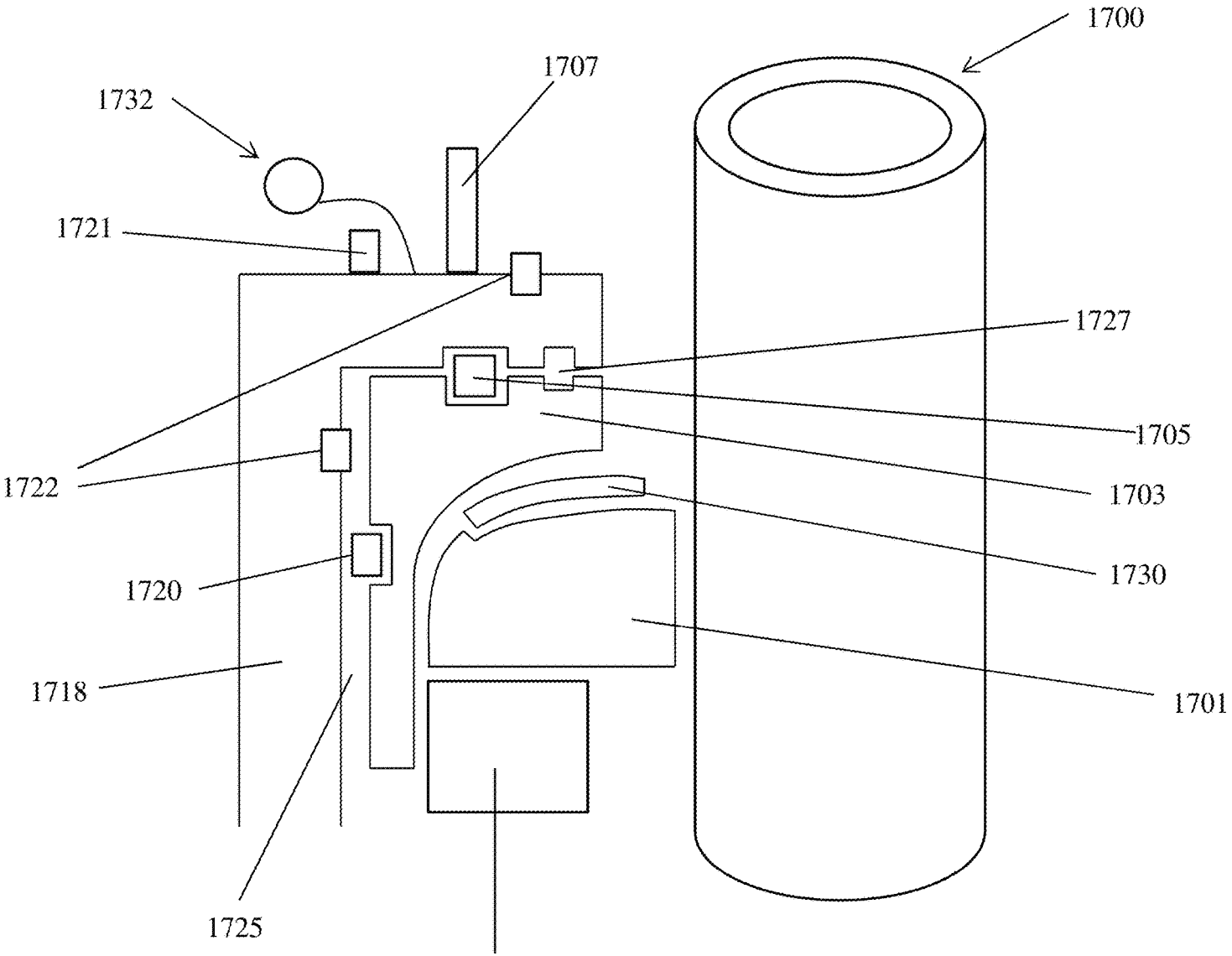
FIG. 15 illustrates a cross-sectional view of a pressure control device according to one or more embodiments of the present disclosure.

Referring now to FIGS. 12-14, FIGS. 12-14 show graphs identifying various responses of the sealing element 1710 of FIG. 10. Thus, explanation of FIGS. 12-14 is provided in conjunction with references to FIG. 10. FIG. 12 shows a graph describing the response of the transducers (1715 and 1720 in FIG. 10) when the sealing element (1701 in FIG. 10) swells due to chemical attacks, such as the presence of hydrocarbons. In such a situation, the volume of the sealing element 1701 becomes larger while also becoming softer. This explains the "push-back" effect of the non-rotary activation piston 1714 (shown by the LVDT 1715), while the tangent stain gauge 1720 may indicate higher tangent stress, as the rubber is softer, and transmit better the axial deformation. Further, in one or more embodiments, it is understood that some rubber deformation may be generated by thermal expansion effect in the case of varying temperature. Thus, this can be estimated from a measured change of temperature.

FIG. 13 shows a graph describing the response of the transducers (1715 and 1720) corresponding to the case where the sealing element 1701 become harder due to aging (especially with exposure to higher temperatures). In such case, the axial loading on the rubber would transfer so easily to the radial direction. Thus, one method to detect this aging effect may be to superpose a small AC pressure fluctuation on to the oil 1702 and to correlate the effect on the LVDT 1715 displacement and the tangent strain gauge 1720. With thermal aging, smaller fluctuation would be detected by these two transducers (1715 and 1720) while still applying the same AC oil pressure fluctuation.

FIG. 14 shows a graph describing the response of transducers (1715 and 1720) corresponding to an increase of bore diameter in the sealing element 1701 due to wear. Such wear may be due to sliding of the tubular 1700 (as it trips though the pressure control device 1750). In such case, the non-rotary activation piston 1714 must make a larger displacement to force the sealing element 1701 against the tubular 1700. Also for the same oil pressure, less tangent stress may be generated as there is more difficulty to create constant contact stress between the sealing element 1701 and the tubular 1700.

Thus, as seen by FIGS. 10 and 12-15, in one or more embodiments, the combination of the LVDT 1715, oil pressure gauge 1710, mud pressure gauge 1717 and temperature 1719 may allow for determination of potential issues in the sealing element 1701, such as swelling, hardening and bore wear. The usage of the tangent strain gauge 1720 may also allow a better estimate of the contact stress between the sealing element 1701 and the tubular 1700. Furthermore, this improves the tracking of potential issues in the sealing element 1701. Additionally, the pressure control device 1750 may also be equipped with an accelerometer 1721, a hydrophone 1722 and/or a microphone 1723 as shown in FIG. 10 (and in greater detail in FIG. 15). These sensors 1721, 1722, and 1723 may detect the noise produced by the thrust bearing 1705 which support a main activation force onto the sealing element 1701. The main activation force may reach more than 100,000 pounds and the thrust bearing 1705 may rotate up to 200 RPM. Further, in one or more embodiments, it may be desirable to ensure that the thrust bearing 1705 is in proper working condition. The sensors 1721, 1722, and 1723 allow for comparison of the noise made during rotation when the thrust bearing 1705 is "new" and after some wear period. If the noise increases above threshold, it may be advisable to change the thrust bearing 1705. One skilled in the would appreciate how different configurations of the pressure control device 1750 may be possible, and still allow proper placement of transducers to ensure the measurements as described above are taken as set forth.

Figure 17:
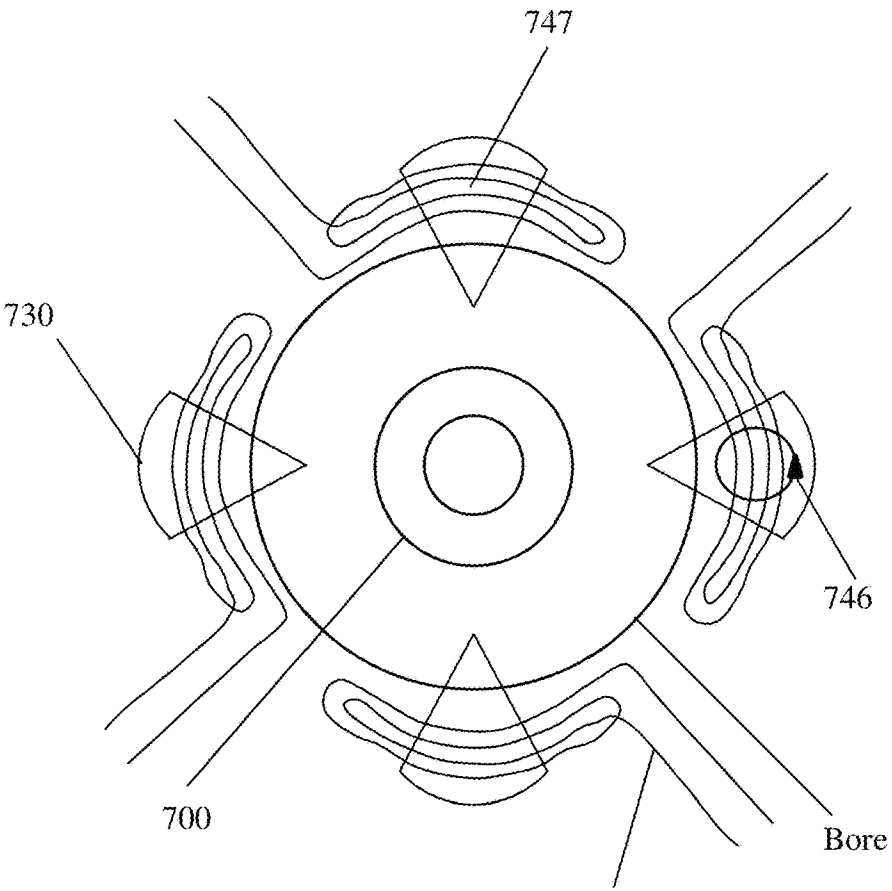
FIG. 17 illustrates a top view of coil configurations in the pressure control device of FIG. 16 according to one or more embodiments of the present disclosure.
Figure 16:
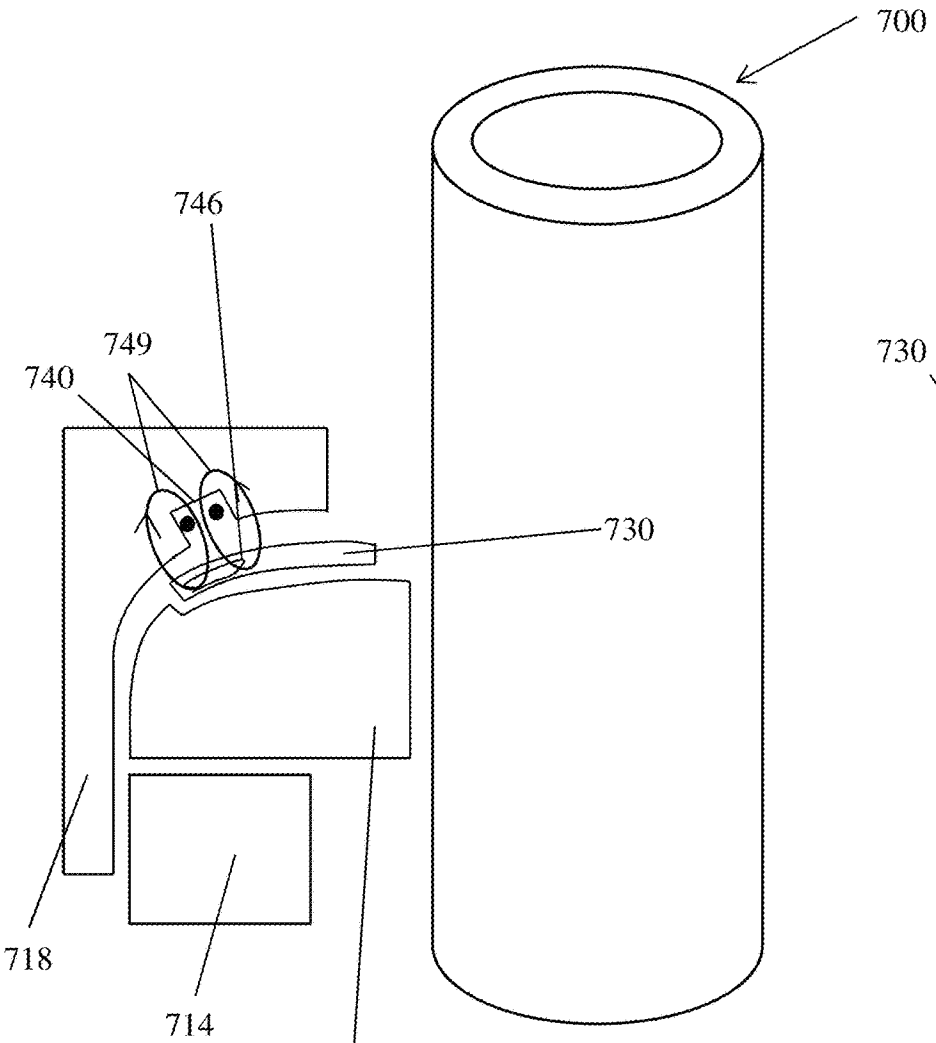
FIG. 16 illustrates a cross-sectional view of a pressure control device according to one or more embodiments of the present disclosure.
Figure 19:
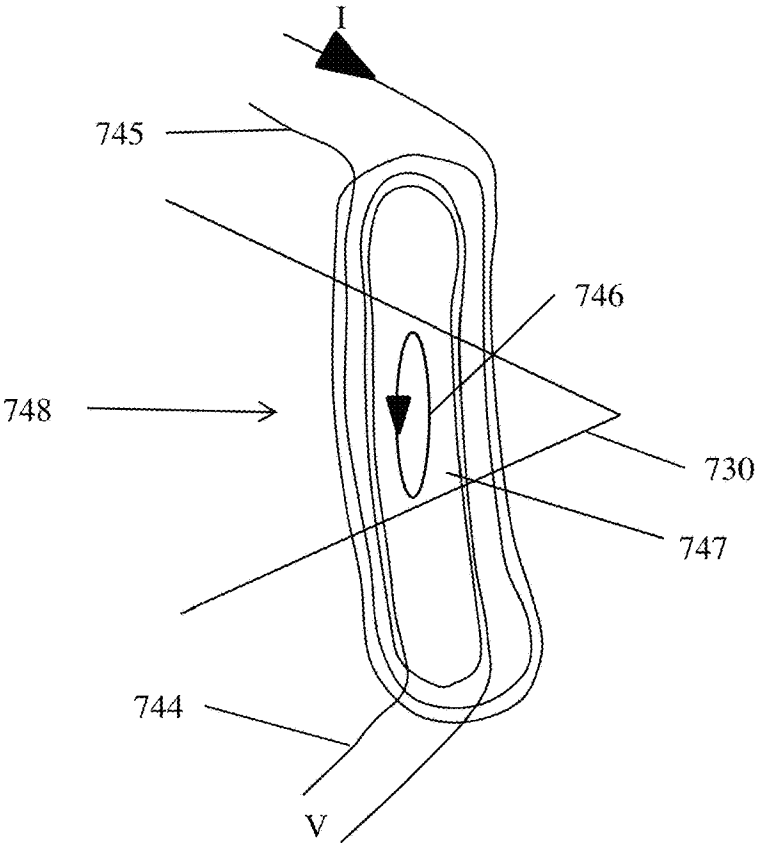
FIG. 19 illustrates a top view of coil configurations in a pressure control device according to one or more embodiments of the present disclosure.
Figure 18:
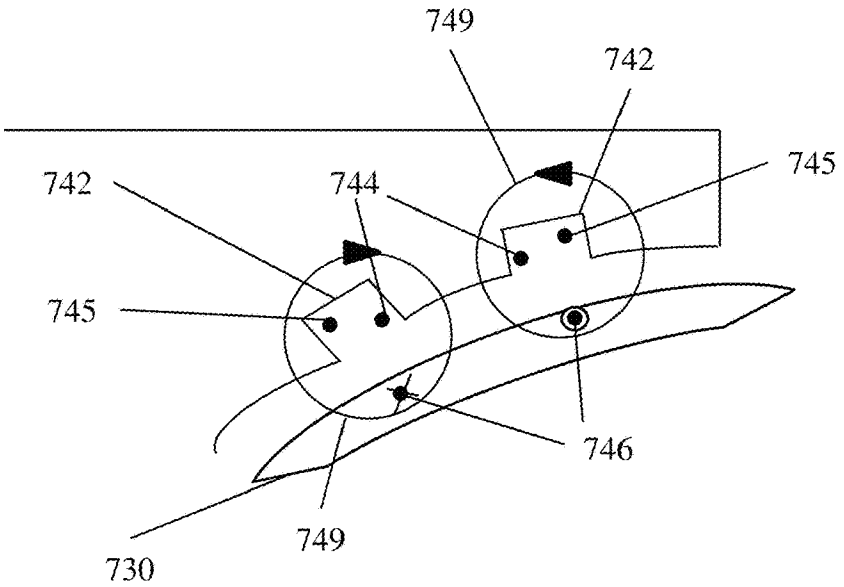
FIG. 18 illustrates a side view of coil configurations in a pressure control device according to one or more embodiments of the present disclosure.

Now referring to FIGS. 16-19, FIGS. 16-19 show embodiments of induction coil(s) (either single or double) to detect the movement a sealing element in a pressure control device. Sealing element 701 is housed within body 718 and includes a plurality of metal teeth 730 molded thereto. Sealing element 701 seals against tubular 700 upon actuation by piston 714. As seal 701 moves, metal teeth 730 move accordingly, and such movement may be detected by coils 741 disposed within a slot 740 formed in body 718 facing metal teeth 730. In one or more embodiments, there may be one (set of) coil 741 per metal tooth 730 as shown in FIG. 17. Further, in one or more embodiments, each set of coil 741 in the slot 740 includes one RCV coil 744 and one TX coil 745, as illustrated in FIG. 19. In one or more embodiments, two independent slots 742, 743 (as shown in FIG. 18) may be formed in body 718, each housing a RCV coil 744 and a TX coil 745. When an AC current I is fed in the TX coil 745, a AC magnetic flux Φ 749 is generated. The AC magnetic flux Φ 749 crosses the RCV coil 744 and ensures the generation of voltage V on the RCV coil 744 output. Also, an eddy current 746 appears in the metal tooth 730, creating a induced magnetic flux which also generates a voltage output at the RCV coil 744 (shifted by 90 degree). Both outputs depends on the overlap section 747 between the coil and the metal tooth 730. As the metal tooth 730 is pushed towards the axis of the pressure control device (in the direction of the arrow 748), the overlap section 747 and the voltage output at the RCV coil 744 will both increase.

In another embodiment, each pair of coil may be driven and monitored separately to allow the location of each metal tooth to be individually considered. However, the set of TX coil can be connected together (in series) for unique drive effect. If the RCV coil are also connected (in series), an overall detection of the metal tooth movement would be provided, but not specific information for each metal tooth.

Figure 20:
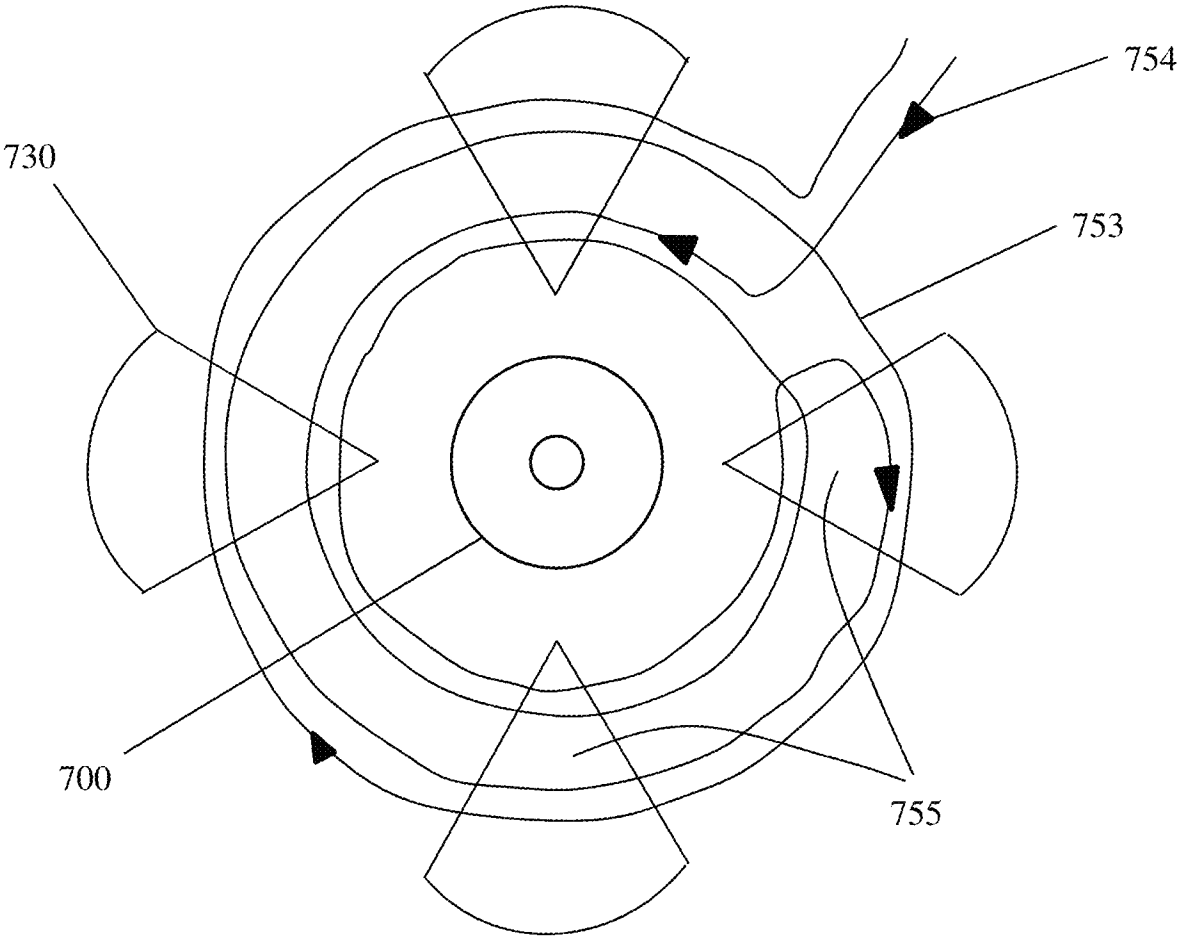
FIG. 20 illustrates a top view of coil configurations in a pressure control device according to one or more embodiments of the present disclosure.

In such a case of connecting all the coils in series (RCV and TX), another embodiment is shown in FIG. 20. A TX coil 753 with its drive current I 754 is shown to wrap around the tubular 700 multiple times. However, the same design may also be applied to a RCV coil. Additionally, the use of a single coil, as configured like the TX coil 753, in place of a pair of coils (TX and RCV) would also be possible. Such outputs depends on the overlap section 747 between the coil 753 and the metal tooth 730.

Figure 21:
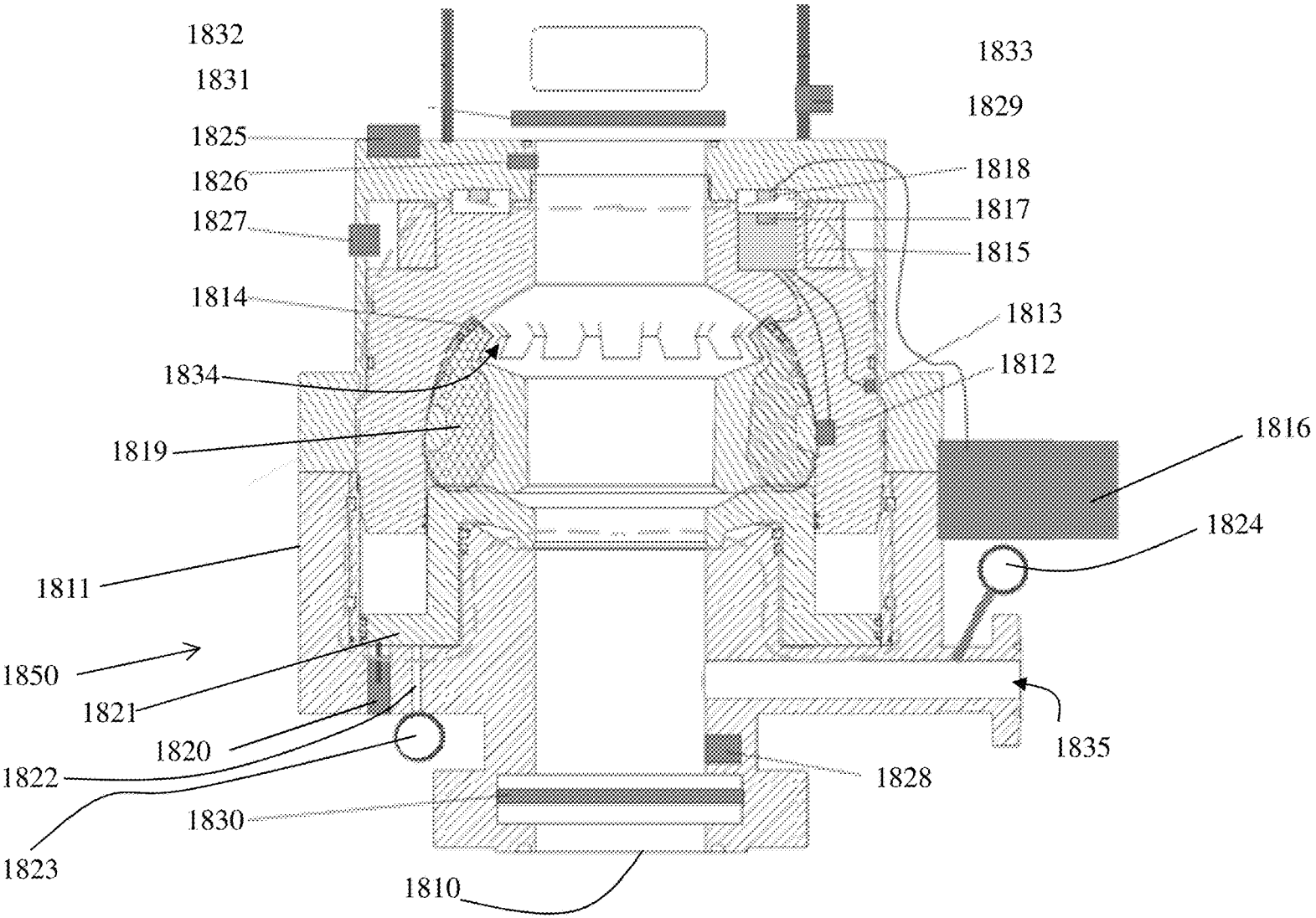
FIG. 21 illustrates a cross-sectional view of pressure control device according to one or more embodiments of the present disclosure.

FIG. 21 shows another embodiment of a pressure control device (such as a rotating annular preventer). Pressure control device 1850 has a body 1811, and a tubular 1810 may pass therethrough. A bell nipple 1832 may be disposed on top of the pressure control device 1850. A sealing element 1819 (having metal teeth 1834 molded thereto) seals against tubular 1810 upon actuation by piston 1821. Upon sealing against tubular 1810, the annulus containing wellbore fluids such as muds may be sealed off. Fluid from the annulus may be diverted from the pressure control device 1850 through outlet 1835 that is located below seal 1819 and piston 1821. Piston 1821 is moved by hydraulic fluid (such as a hydraulic oil) that may be measured by pressure gauge 1823. In one or more embodiments, the pressure control device includes an ultra-sonic sensor 1812 for characterization of the sealing element 1819 (specifically the elastomeric portion of the sealing element 1819). The ultra-sonic sensor 1812 may send sound wave (not shown) into a rubber of the sealing element 1819, which will be reflected at the interface of the bore of the sealing element 1819 with the tubular 1810. The travel time from the sound waves as well as the amplitude of the received signal will be measured. From the travel time of the wave and the knowledge of the tubular diameter, the sound velocity in the sealing element 1819 may be determined. Additionally, from the amplitude of the received signal, the acoustic attenuation in the sealing element 1819 may be determined. The sound velocity and the acoustic attenuation data may allow for characterization of the sealing element 1819 to determine, for example, a compression stress (which generates an increase of sound velocity and lower the attenuation), a chemical swelling (which generates a decrease of sound velocity and an increase of attenuation), and an increase of temperature (which generates a decrease of sound velocity and attenuation).

Another sensor that may be included in pressure control device 1850 is a strain gauge 1813, which is discussed above in FIG. 10. Further, pressure control device 1850 may also include coil(s) 1814 adjacent metal teeth 1834, as discussed in FIGS. 16-20, for determination of teeth position. Each of the sensors 1812, 1813, 1814 are connected to a rotary electronic system 1815 which feeds power to these sensors 1812, 1813, and 1814 and performs data acquisition on these sensors 1812, 1813, and 1814. The rotary electronic system 1815 may communicate with the static parts of the pressure control device 1850 and a controller such as programmable logic controller (PLC) 1816 via a rotary communication coil 1817 and an annular static communication coil 1818.

As discussed above with respect to FIG. 10, pressure control device 1850 may also include a linear variable differential transformer (LVDT) 1820 that is able to determine the position of a piston 1821. The displacement of piston 1821 corresponds to radial deformation of a sealing element 1819 which squeezes against the tubular 1810. In such construction, the push-force on the sealing element 1819 is primarily imposed by an oil (not shown) supplied in an oil chamber 1822. There may be a direct relation between the push force and the measured oil pressure from an oil pressure gauge 1823. In one or more embodiments, the push-force on the activation of the sealing element 1819 may be a combination of the force created by the pressurized oils and an additional push force created by a pressurized mud (not shown) below the pressure control device 1850. The mud effect can be determined by a gauge 1824 measuring the mud pressure. Furthermore, a mud temperature is also tracked by the gauge 1824.

In one or more embodiments, the pressure control device 1850 may also be equipped with an accelerometer 1825, a hydrophone 1826 and/or a microphone 1827, such as shown in FIG. 10. The sensors 1825, 1826, and 1827 allow for the comparison of noise made during rotation of sealing element 1819 when a bearing (not shown) is "new" and after some wear period. If the noise increases above threshold, it may be advisable to change the bearing (not shown). Further pressure control device 1850 also includes a lower set of ultra-sonic sensor 1828 and an upper set of ultra-sonic sensor 1829, each of which may be made of several sensors which can transmit and receive ultra-sonic pulses. Furthermore, above the pressure control device 1850 is an upper-set of coils 1831, and a lower set of coils 1830 is installed at a bottom of the pressure control device 1850. These two sets of coils 1830, 1831 may include multiple coils as described above (such as in FIG. 6), and may detect a tubular connection (not shown) reaching the pressure control device 1850 from either direction (moving axially into the pressure control device 1850 from either the top or the bottom of the device). A pair of radial coil 1833 (such as configured in FIG. 11) may be installed above and below the pressure control device 1850, and may be used to detect small surface defects (such as less than 1 mm) with radial patterns on the surface of the tubular 1810. In one or more embodiments, each of the above described sensors and coil transmit data to and/or are controlled by the controller 1816.

In one or more embodiments, a feedback control loop (not shown) may be used to control the operation of the pressure control device 1850. The feedback control loop can seal the tubular 1810 without excessive wear and tear of the sealing element 1819. In operation, depending on the needs of seal between the sealing element 1819 and the tubular 1810, the oil pressure may be adjusted to change axial position of the piston 1821. For example, when a large OD tubular or a tubular connection is to pass through the pressure control device 1850, the hydraulic oil pressure may be reduced, thus allowing the opening of the sealing element 1819 to be increased and allowing the larger OD tubular to be sealed (or the seal to be retracted) with minimal damage to the sealing element 1819. Another example is when a leakage is detected above the sealing element 1819, the hydraulic oil pressure may be increased, squeezing the sealing element 1819 to achieve a better seal. Additionally, the distance between the piston 1821 and the outer body 1811 may be used to monitor the health state of the sealing element 1819. Thus, when this distance exceeds certain limit, it may be used as an indicator of degradation of the sealing element 1819, thereby triggering the maintenance of the pressure control device 1850, such as an inspection or a replacement of the sealing elements 1819.

Figure 22:
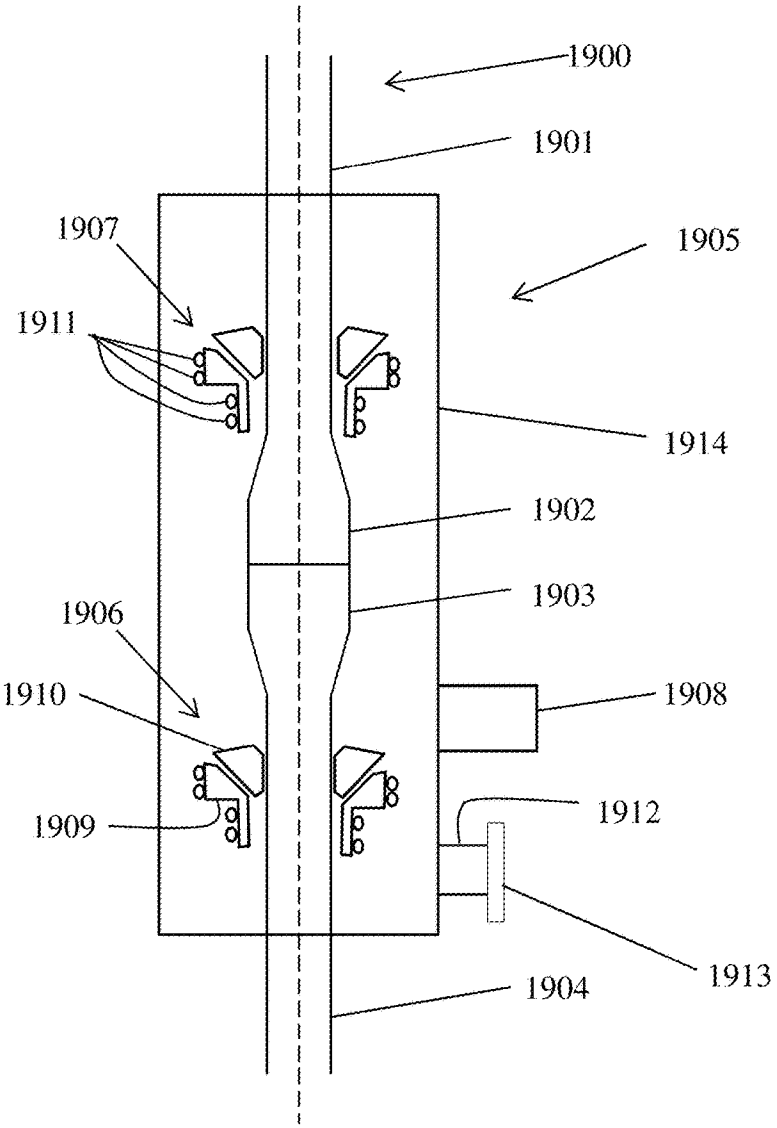
FIG. 22 illustrates a cross-sectional view of pressure control device according to one or more embodiments of the present disclosure.

Referring now to FIG. 22, another embodiment of a pressure control device is shown. As shown, the pressure control device 1905 may be a multi-stage device having multiple sealing stages therein, which may further prolong the life of the sealing element. In one or embodiment, a tubular string 1900 passing thru the multi-stage pressure control 1905 has a first tubular 1901 with a connection end 1902 connected to a second connection 1903 end of a second tubular 1904. Those skilled in the art would appreciate how the tubular string 1900 may be any string of tubulars that connect end-to-end such as, but not limited to, drill pipe string or casing string. The multi-stage pressure control device 1905 has a lower sealing stage 1906 and an upper sealing stage 1907, however the multi-stage pressure control device 1905 is not limited to just two sealing stages. Furthermore, in one or more embodiments, each sealing stage 1906, 1907 may only seal on the body of the tubular 1904, 1901. Thus, one of the sealing stages 1906, 1907 may seal against the tubular body 1904, 1901 while allowing non-obstruction pass through of the connection 1902, 1903 of the tubular through the other of the sealing stages 1906, 1907. In one or more embodiments, the lower sealing stage 1906 and the upper sealing stage 1907 are controlled to open and close by a controller such as a programmable logic controller 1908. The controller 1908 will activate a piston 1909 having a wedge face to move up and down adjacent to a bottom or outer radial surface of a sealing element 1910. Thus, the sealing element 1910 is configured to close around the tubular body 1904, 1901 when the piston 1909 moves up, thus sealing off an annulus between the tubular 1904, 1901 and wellbore (not shown). Further, a bearing assembly 1911 is disposed on the piston 1909 at an outer radial surface thereof. The bearing assembly 1911 allows for the rotation of piston 1909 (and the sealing element 1910 via its engagement with the piston 1909) within the multi-stage pressure control device 1905. The rotation of the sealing element 1910 and the piston 1909 may result from rotation of the tubular 1904, 1901 sealed at an inner surface of the sealing element 1910. Thus, as the tubular 1904, 1901 rotates, the sealing engagement between tubular 1904, 1901 and the sealing element 1910 and the engagement between the sealing element 1910 and the piston 1909 causes the sealing element 1910 and the piston 1909 to rotate along with tubular 1904, 1901. Further, it is intended that the lower sealing stage 1906 and the upper sealing stage 1907 may be configured as any embodiment described above (FIGS. 1-21).

Still referring to FIG. 22, when the tubular connection 1902, 1903 is between the lower sealing stage 1906 and the upper sealing stage 1907, both the lower sealing stage 1906 and the upper sealing stage 1907 may be sealed around the bodies of the tubular 1904, 1901. When the connection 1902, 1903 (of a different size) of the tubular 1904, 1901 is approaching the upper sealing stage 1907, the lower sealing stage 1906 is activated to seal around the body of the tubular 1904, 1901. Additionally, the upper sealing stage 1907 is deactivated from the tubular 1904, 1901, thereby allowing the tubular connection 1902, 1903 to freely pass through the upper sealing stage 1908. Once the tubular connection 1902, 1903 passes the upper sealing stage 1907, the upper sealing stage 1907 is activated to create a seal between the upper sealing stage 1907 and the tubular 1904, 1901. Then the lower sealing stage 1906 is deactivated, allowing the tubular connection 1902, 1903 to pass thought the lower sealing stage 1906 without obstruction. When either sealing the lower sealing stage 1906 and the upper sealing stage 1907 (either to a tubular or on itself), fluids present in the annulus of the wellbore may flow through an outlet 1912 present in a body 1914 to be diverted outside of the multi-stage pressure control device 1905 (upon opening of a valve 1913, which may be hydraulically operated in one or more embodiments and controlled by controller (now shown)). As illustrated, outlet 1912 is located below the lower sealing stage 1906 and is in fluid communication with the annulus. The multi-stage pressure control device 1905 may significantly prolong the life of the sealing elements as it reduces the damage on the sealing elements from the tubular connection.

Figure 23:
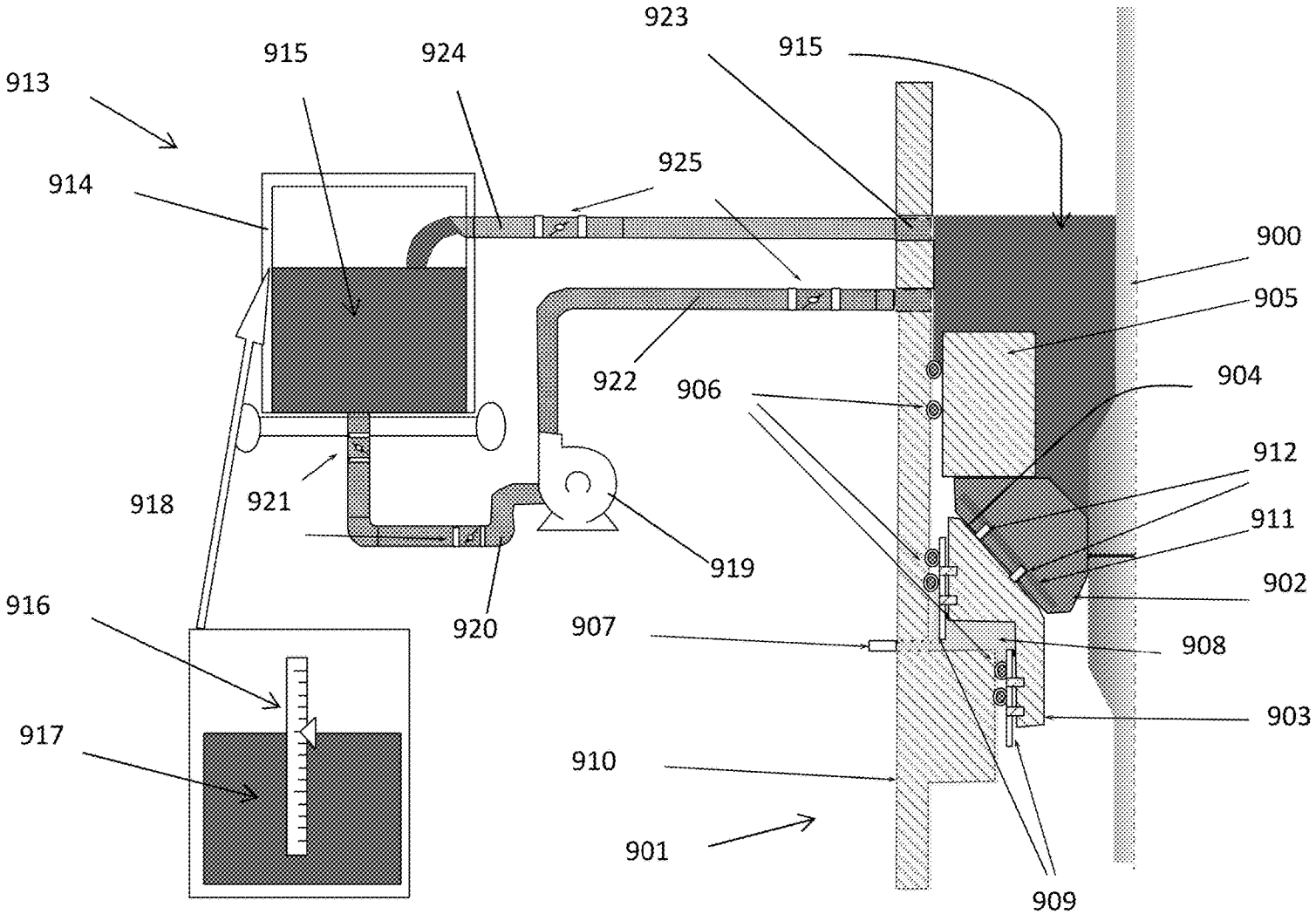
FIG. 23 illustrates a cross-sectional view of pressure control device according to one or more embodiments of the present disclosure.

Referring now to FIG. 23, in one or more embodiments, a pressure control device (such as a rotating annular preventer) 901 has an outer body 910 which houses a sealing element 902 that closes around a tubular 900. Those skilled in the art would appreciate how the tubular 900 may be any string of tubulars that connect end-to-end such as, but not limited to, drill pipe string. Additionally, an axially movable piston 903 is used to actively engage with the sealing element 902 (which may be formed from a plurality of interlocking sealing elements) at a slant surface 904 to seal around the tubular 900. In one or more embodiments, a wellhead pressure (not shown) may be used to assist the movement of the axially movable piston 903. A cylindrical sleeve 905 is attached to the seal 902 such that the cylindrical sleeve 905 and the sealing element 902 rotate as one body. A plurality of thrust bearing 906 can be disposed between the cylindrical sleeve 905 and the outer body 910 and/or the axially movable piston 903 the outer body 910. The plurality of thrust bearing 906 allows relative rotational movement between the cylindrical sleeve 905 and the outer body 910 and/or the axially movable piston 903 and the outer body 910. Furthermore, the outer body 910 has a hydraulic oil inlet 907, which feeds a hydraulic oil into chamber 908, thereby causing the axial movement of piston 903. The hydraulic oil inlet 907 allows a pressure of a hydraulic oil in chamber 908 between the axially movable piston 903 and the outer body 910 to be controllable, thereby affecting the sealing element 902 against the tubular 900.

Movement of the piston 903 and sealing element 902 vis a vis the piston 903 may be facilitated by a plurality of guide tracks 911 and a plurality of guides 912 that move within guide tracks 911.

Additionally, the sealing element 902 of the pressure control device 901 may experience two types of friction namely: a static friction experienced when the motion of the tubular 900 are initiated and a kinetic friction between the sealing element 902 and the moving tubular 900. The frictional energy dissipated by the movement of the tubular 900 results in thermal energy generation that may then diffuses into the sealing element 902. The elevated temperature of the sealing element 902 may alter the mechanical properties of the sealing material. In order to minimize the impact of frictional forces, a lubrication system 913 may be installed in the outer body 910. A buffer tank 914 contains a small reservoir of a fluid 915 such as, but not limited to, drilling fluid used in the well drilling process. Additionally, those skilled in the art would appreciate that the properties of the fluid 915 in the buffer tank 914 may be modified in order to obtain maximum lubricity and reduce the coefficient of friction. An arrow 918 shows a view of the buffer tank 914 which may be equipped with appropriate instrumentation 916 in order to measure a stored volume 917 in real time through level measurement. A pumping unit 919 may facilitate the fluid 915 of the buffer tank 914 to be introduced into the pressure control device 901. Furthermore, the pumping unit 919 may be any pumping device used to move fluids known in the art and may be sized according the head pressure requirements needed to pump the fluid 915 to the pressure control device 901. In order to establish a constant circulation, the pumping unit 919 may pump the fluid 915 from the buffer tank 914 at a constant rate. A pipe 920 between the buffer tank 914 and the pumping unit 919 may be equipped with at least one or more valves 921 in order to isolate either the buffer tank 914 or the pumping unit 919. An inlet line 922 from the pumping unit 919 to the pressure control device 901 will facilitate entry of the fluid 915 above the sealing element 902 thereby resulting in the fluid 915 occupying the space between the sealing element 902 and a return point 923. Additionally, a return line 924 connected to the return point 923 may facilitate the fluid 915 flowing from the pressure control device 901 back to the buffer tank 914. Furthermore, the inlet line 922 and the return line 924 may be equipped with an isolation valves 925 to facilitate the return of the fluid from the device back to the buffer tank 914 or to maintain the amount of fluid 915 in the pressure control device 901. Those skilled in the art may appreciate how the return line 924 may be provisioned with appropriate instrumentation to measure the amount of fluid 915 returning back to the buffer tank 914.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A pressure control device, comprising:

a body having a central axis extending therefrom;

at least one rotatable seal within the body, the rotatable seal configured to seal against a tubular extending through the pressure control device along the central axis and rotate within the body with the tubular;

at least one coil within the body wrapped at least once around the central axis, wherein the at least one coil is configured to send characteristics of the tubular to a controller, and wherein the at least one coil comprises a single coil for transmitting and receiving; and an outlet to divert fluid from an annulus, wherein the outlet is located axially below the at least one rotatable seal, and wherein the controller is configured to control the at least one rotatable seal and its engagement against the tubular based on the characteristics of the tubular received by the controller.

2. The pressure control device of claim 1, wherein the at least one coil comprises at least one transmitting coil located above the at least one rotatable seal and at least one receiving coil located below the at least one rotatable seal.

3. The pressure control device of claim 1, wherein the at least one rotatable seal is actuated by a piston.

4. The pressure control device of claim 3, further comprising a bearing assembly disposed on an outer radial surface of the piston, thereby providing rotation for the at least one rotatable seal.

5. The pressure control device of claim 3, further comprising a linear variable differential transformer within the body to measure the position of the piston.

6. The pressure control device of claim 1 at least one sensor within the body, wherein the at least one sensor is configured to send characteristics of the tubular and the at least one rotatable seal to the controller.

7. The pressure control device of claim 6, wherein at least one sensor is an ultrasonic sensor, an accelerometer, a hydrophone, a microphone, and/or a tangent strain gauge.

8. The pressure control device of claim 1, further comprising a rotary compression system attached within the body by a first bearing assembly and a rotary support attached within the body by a second bearing assembly, thereby providing for rotation of the at least one rotatable seal.

9. The pressure control device of claim 8, wherein the at least one rotatable seal is located between the rotary compression system and the rotary support.

10. The pressure control device of claim 8, further comprising a non-rotary activation piston within the body above the rotary compression system.

11. The pressure control device of claim 10, further comprising a linear variable differential transformer within the body to measure the position of the non-rotary activation piston.

12. The pressure control device of claim 1, further comprising at least two or more rotatable seals within the body, wherein each is configured to seal against a body of the tubular and open when a connection between two tubulars passes therethrough.

13. A pressure control device, comprising:

a body having a central axis extending therefrom;

at least one rotatable seal within the body, the rotatable seal configured to seal against a tubular extending through the pressure control device along the central axis and rotate within the body with the tubular;

at least one coil within the body wrapped at least once around the central axis, wherein the at least one coil is configured to send characteristics of the tubular to a controller;

an outlet to divert fluid from an annulus, wherein the outlet is located axially below the at least one rotatable seal, wherein the controller is configured to control the at least one rotatable seal and its engagement against the tubular based on the characteristics of the tubular received by the controller; and at least one slot in the body to hold the at least one coil, the at least one coil configured to detect movement of a metal tooth attached to the at least one rotatable seal.

14. A pressure control device, comprising:

a body having a central axis extending therefrom;

at least one rotatable seal within the body, the rotatable seal configured to seal against a tubular extending through the pressure control device along the central axis and rotate within the body with the tubular;

at least one coil within the body wrapped at least once around the central axis, wherein the at least one coil is configured to send characteristics of the tubular to a controller; and an outlet to divert fluid from an annulus, wherein the outlet is located axially below the at least one rotatable seal, and wherein the controller is configured to control the at least one rotatable seal and its engagement against the tubular based on the characteristics of the tubular received by the controller;

a rotary compression system attached within the body by a first bearing assembly and a rotary support attached within the body by a second bearing assembly, thereby providing for rotation of the at least one rotatable seal, wherein the at least one rotatable seal is located between the rotary compression system and the rotary support; and a non-rotary activation piston within the body above the rotary compression system, wherein the non-rotary activation piston is actuated by an oil pressure, thereby compressing the rotary compression system and the rotary support on the at least one rotatable seal.

* * * * *